US010433601B2

(12) United States Patent
Bourn

(10) Patent No.: US 10,433,601 B2
(45) Date of Patent: Oct. 8, 2019

(54) SLIDE-INHIBITING SAFETY GARMENT FOR ICE AND ASSOCIATED METHOD

(71) Applicant: Charles T. Bourn, Lacombe (CA)

(72) Inventor: Charles T. Bourn, Lacombe (CA)

( * ) Notice: Subject to any disclaimer, the term of this patent is extended or adjusted under 35 U.S.C. 154(b) by 0 days.

(21) Appl. No.: 16/166,094

(22) Filed: Oct. 20, 2018

(65) Prior Publication Data

US 2019/0116903 A1 Apr. 25, 2019

Related U.S. Application Data

(60) Provisional application No. 62/575,155, filed on Oct. 20, 2017.

(51) Int. Cl.

| | |
|---|---|
| ***A41D 31/02*** | (2019.01) |
| ***A41D 1/04*** | (2006.01) |
| ***A41D 1/08*** | (2018.01) |
| ***A63B 71/14*** | (2006.01) |
| ***A63B 71/12*** | (2006.01) |
| *A63B 102/24* | (2015.01) |

(52) U.S. Cl.

CPC ..... *A41D 31/02* (2013.01); *A41D 1/04* (2013.01); *A41D 1/08* (2013.01); *A63B 71/12* (2013.01); *A63B 71/1225* (2013.01); *A63B 71/143* (2013.01); *A41D 2400/22* (2013.01); *A41D 2400/60* (2013.01); *A41D 2400/80* (2013.01); *A41D 2500/10* (2013.01); *A41D 2600/10* (2013.01); *A63B 2071/125* (2013.01); *A63B 2071/1258* (2013.01); *A63B 2102/24* (2015.10)

(58) Field of Classification Search

CPC . A41D 31/02; A41D 1/04; A41D 1/08; A63B 71/12; A63B 71/1225; A63B 71/143

USPC ..... 2/69, 115, 125, 108, 227

See application file for complete search history.

(56) References Cited

U.S. PATENT DOCUMENTS 350,372 A 10/1886 Leake
5,388,271 A * 2/1995 Sessoms ..... A41D 13/0015 2/113

(Continued)

FOREIGN PATENT DOCUMENTS

EP 2006127 A2 12/2008
JP 4191324 B2 12/2008

(Continued)

*Primary Examiner* — Gloria M Hale

(74) *Attorney, Agent, or Firm* — Charles A. Lemaire; Jonathan M. Rixen; Lemaire Patent Law Firm, P.L.L.C.

(57) ABSTRACT

The present invention includes a method and apparatus for inhibiting sliding on ice or snow, for example, hockey jerseys and/or hockey pants made of a material, such as microfiber cloth, that inhibits sliding when a hockey player falls to the ice at speed. In some embodiments, the hockey garment includes an outer layer of micro-fiber material. The garment is optionally a hockey jersey, pants, elbow covering, kneepads, gloves, shin covering, forearm covering, and/or pants having a plurality of separated areas of micro-fiber material. Optionally, the garment includes stitching that sews the micro-fiber material to a plurality of inner cloth layers using a plurality of at least five curvilinear stitching paths equally spaced from one another through a first area of the garment and a plurality of at least five curvilinear paths equally spaced from one another through a second area of the garment spaced apart from the first area.

20 Claims, 13 Drawing Sheets

(56) References Cited

U.S. PATENT DOCUMENTS

| | | | | |
|---|---|---|---|---|
| 5,758,363 | A * | 6/1998 | Winfree | A41D 1/04 2/108 |
| 6,128,783 | A * | 10/2000 | Blauer | A41D 1/04 2/90 |
| 7,044,173 | B2 | 5/2006 | Silver | |
| 7,465,683 | B2 | 12/2008 | McMurray | |
| 7,762,286 | B1 | 7/2010 | Speaks et al. | |
| 2004/0132367 | A1* | 7/2004 | Rock | A41D 3/005 442/76 |
| 2004/0224121 | A1 | 11/2004 | Sheppard | |
| 2007/0141940 | A1* | 6/2007 | Baychar | A41D 31/0038 442/328 |
| 2010/0162590 | A1 | 7/2010 | Bonigk | |
| 2011/0119811 | A1* | 5/2011 | Rock | A41D 31/0038 2/243.1 |
| 2012/0122365 | A1* | 5/2012 | Erickson | B32B 5/026 442/312 |
| 2013/0196109 | A1* | 8/2013 | Rock | A41D 31/0038 428/76 |
| 2014/0283289 | A1 | 9/2014 | Hawkins | |
| 2015/0038040 | A1* | 2/2015 | Gabbay | D03D 15/0061 442/189 |
| 2015/0104604 | A1* | 4/2015 | Rock | B32B 27/08 428/86 |
| 2017/0013888 | A1 | 1/2017 | Webb | |
| 2017/0172216 | A1* | 6/2017 | Casali | A41D 31/12 |

FOREIGN PATENT DOCUMENTS

| | | | |
|---|---|---|---|
| WO | WO_2008094049 | A1 | 8/2008 |
| WO | WO_2012138569 | A1 | 10/2012 |

* cited by examiner

FIG. 1A1
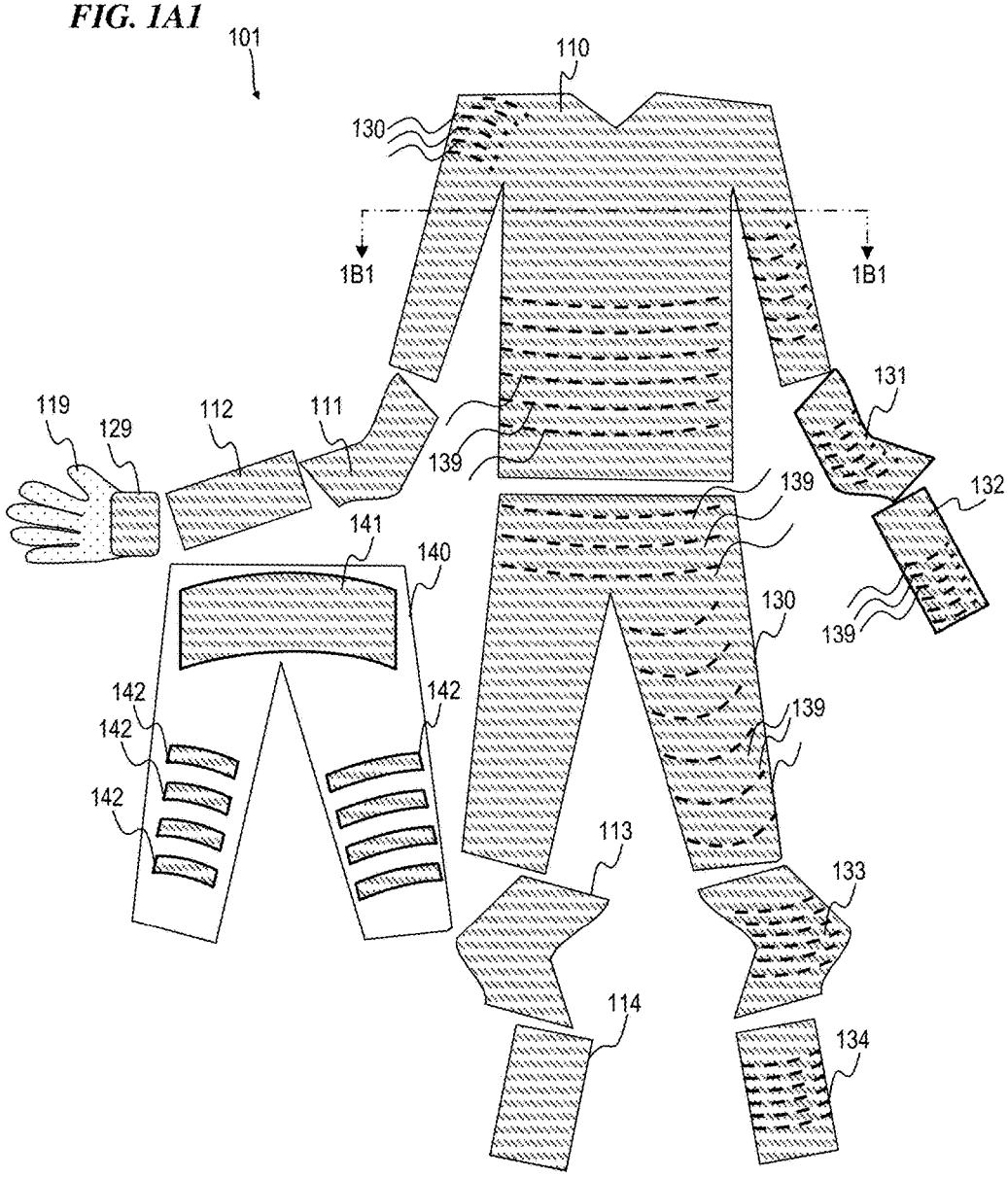
FIG. 1B1
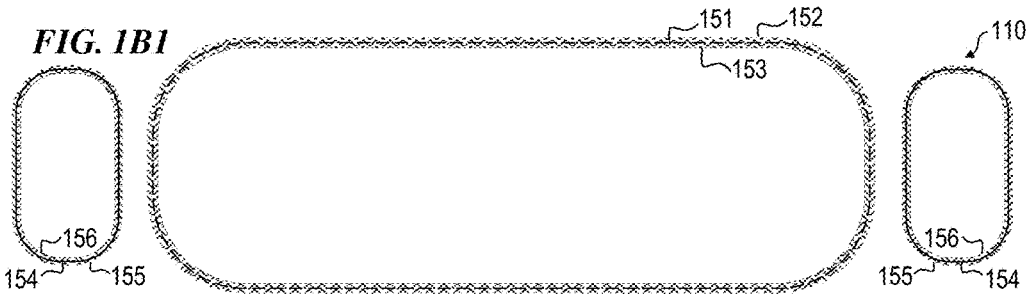

FIG. 1A2
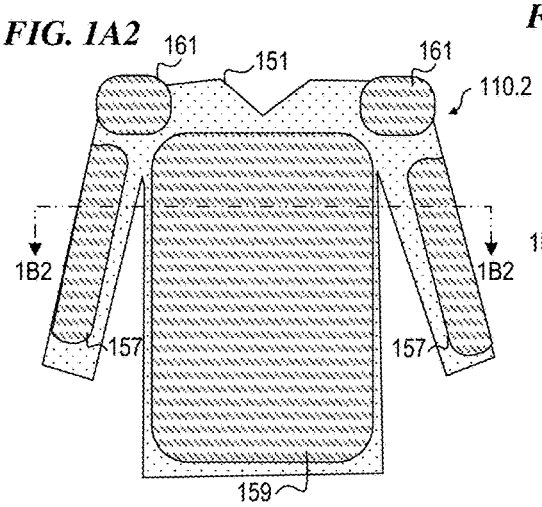
FIG. 1A3
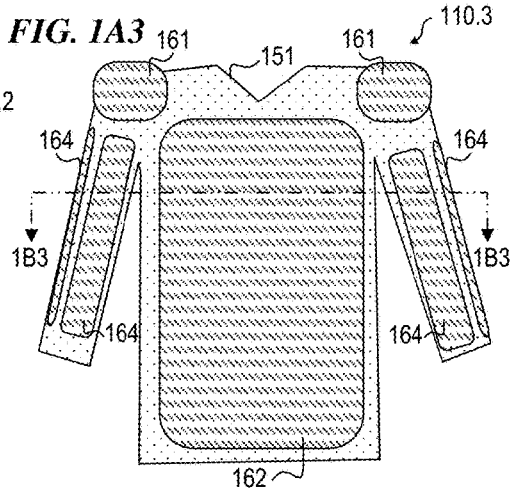
FIG. 1B2
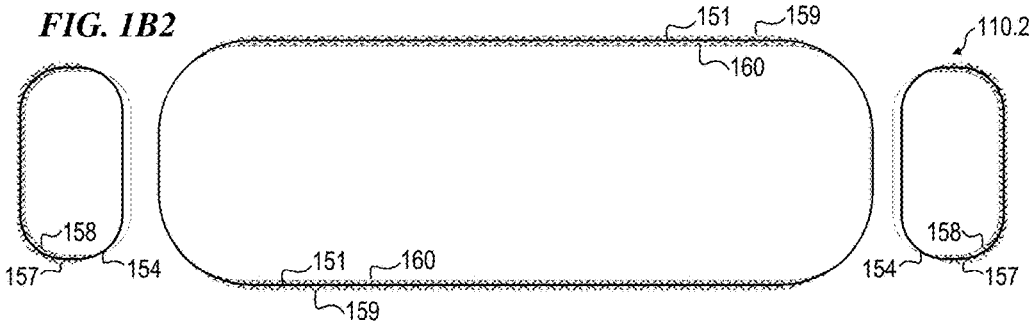
FIG. 1B3
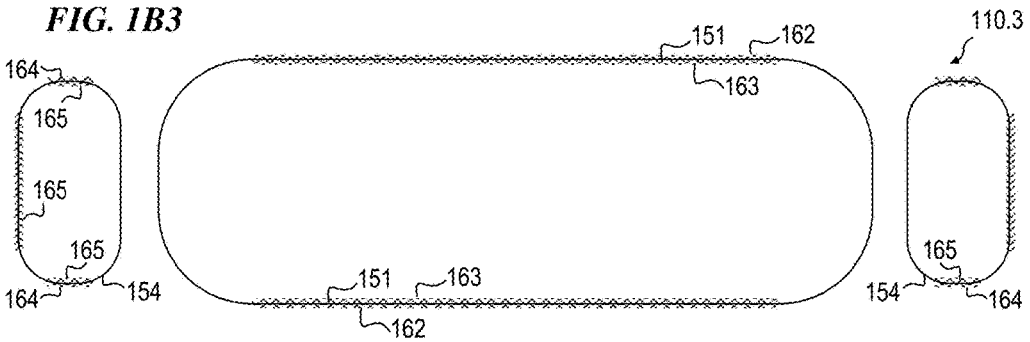

FIG. 1A4
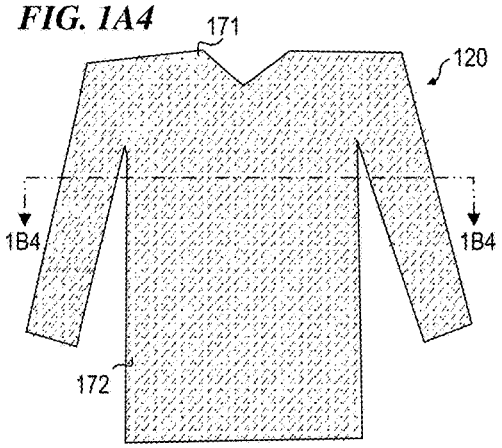
FIG. 1A5
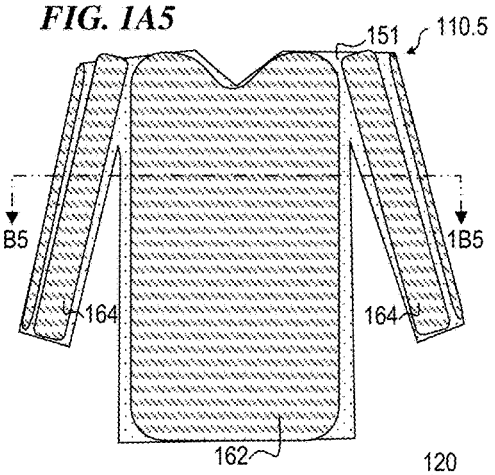
FIG. 1B4
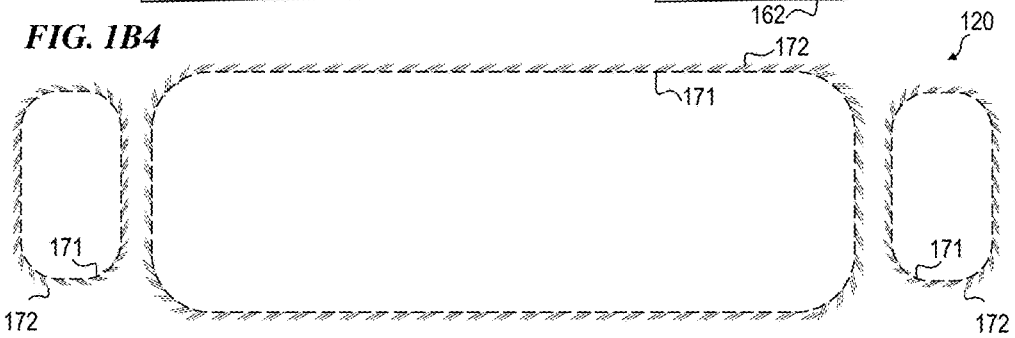
FIG. 1B5
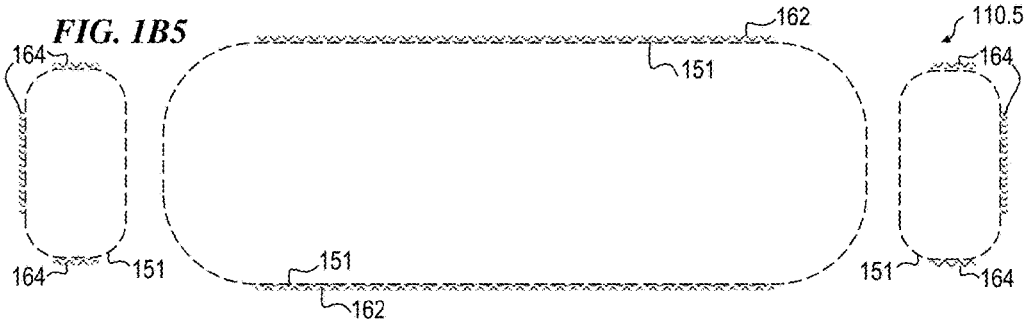
FIG. 1A6
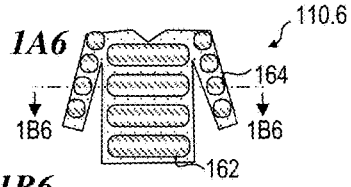
FIG. 1A7
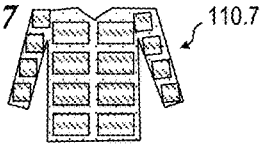
FIG. 1B6
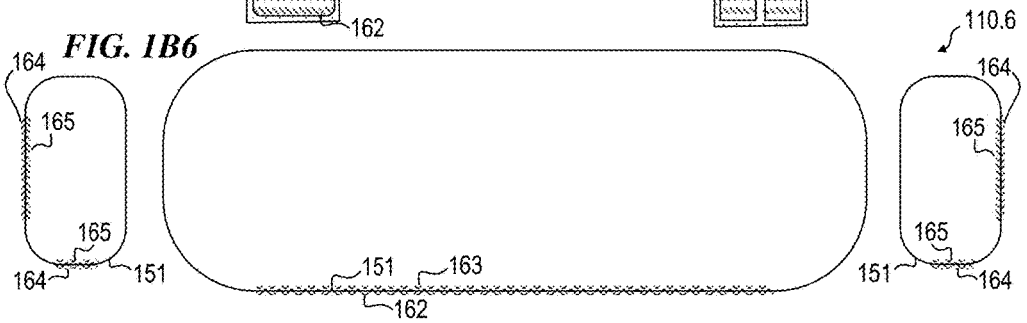

*FIG. 2A*

SafeSlide Jersey Test

Oct. 17, 2017

| | | Distance of Slide |
|---|---|---|
| *2C →2D…* | Pass 1 - Regular Polyester Jersey | 40 ft. 5 in. |
| *2E →2F…* | Pass 2 - Regular Polyester Jersey | 40 ft. 9 in. |
| *3A →3B…* | Pass 3 - Microfiber Jersey | 22 ft. 6 in. |
| *4A →4B…* | Pass 4 - Microfiber Jersey | 17 ft. 11 in. |
| *5A →5B…* | Pass 5 - Regular Polyester Jersey | 44 ft. 9 in. |
| *6A →6B…* | Pass 6 - Regular Polyester Jersey | 46 ft. 0 in. |
| *7A →7B…* | Pass 7 - Microfiber Jersey | 20 ft. 2 in. |
| *8A →8B…* | Pass 8 - Microfiber Jersey | 23 ft. 0 in. |
| | Average Slide w/ Polyester Jersey | 43 ft. |
| | Average Slide w/ Microfiber Jersey | 21 ft. |

*FIG. 2B*

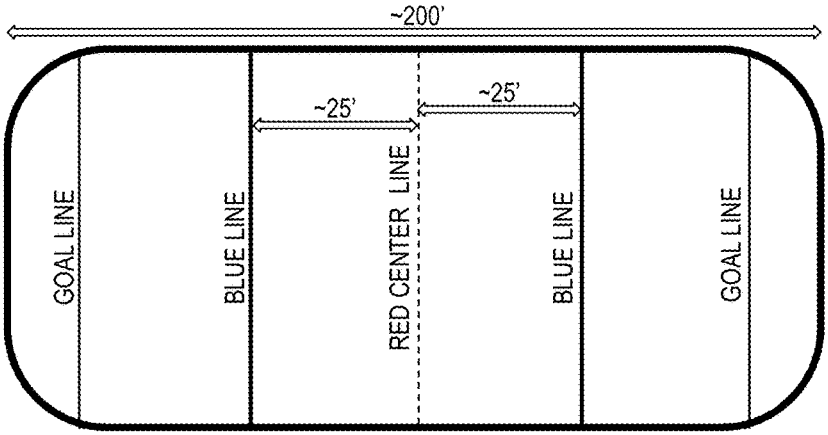

START OF PASS 1 SLIDE IN CONVENTIONAL GARMENT

END OF PASS 1 SLIDE IN CONVENTIONAL GARMENT

START OF PASS 2 SLIDE IN CONVENTIONAL GARMENT

END OF PASS 2 SLIDE IN CONVENTIONAL GARMENT

START OF PASS 3 SLIDE IN SLIDE-INHIBITING GARMENT

END OF PASS 3 SLIDE IN SLIDE-INHIBITING GARMENT

START OF PASS 4 SLIDE IN SLIDE-INHIBITING GARMENT

END OF PASS 4 SLIDE IN SLIDE-INHIBITING GARMENT

START OF PASS 5 SLIDE IN CONVENTIONAL GARMENT

END OF PASS 5 SLIDE IN CONVENTIONAL GARMENT

START OF PASS 6 SLIDE IN CONVENTIONAL GARMENT

END OF PASS 6 SLIDE IN CONVENTIONAL GARMENT

START OF PASS 7 SLIDE IN SLIDE-INHIBITING GARMENT

END OF PASS 7 SLIDE IN SLIDE-INHIBITING GARMENT

START OF PASS 8 SLIDE IN SLIDE-INHIBITING GARMENT

END OF PASS 8 SLIDE IN SLIDE-INHIBITING GARMENT

SLIDE-INHIBITING SAFETY GARMENT FOR ICE AND ASSOCIATED METHOD

CROSS-REFERENCE TO RELATED APPLICATION

This application claims priority benefit, under 35 U.S.C. § 119(e), of U.S. Provisional Patent Application 62/575,155 filed Oct. 20, 2017 by Charles T. Bourn, titled "SLIDE-INHIBITING SAFETY GARMENT FOR ICE AND ASSOCIATED METHOD," which is incorporated herein by reference in its entirety.

FIELD OF THE INVENTION

This invention relates to the field of safety garments, and more specifically to a method and apparatus for inhibiting sliding on ice, for example garments such as hockey jerseys and/or hockey pants made of a material, such as microfiber cloth, that inhibits sliding when a hockey player falls to the ice at speed.

BACKGROUND OF THE INVENTION

Certain marks referenced herein may be common-law or registered trademarks of third parties affiliated or unaffiliated with the applicant or the assignee. Use of these marks is for providing an enabling disclosure by way of example and shall not be construed to limit the scope of the claimed subject matter to material associated with such marks.

Hockey players recognize the need for safety equipment, such as helmets, shoulder pads, elbow pads, gloves, pelvic protectors, shin guards, mouth guards and neck guards. Neck guards may help protect against broken necks, however, when a player falls or is pushed to the ice when skating at high speed, the player can end up sliding head-first into the wall around the rink, a goal post or another player, possibly resulting in head and neck injuries, or feet-first or sideways, possibly resulting in broken ankles, legs, arms or pelvis. There is little that a player in that situation can do to slow or stop the slide.

Prior-art attempts at ice traction and safety in other contexts include the following patent publications, each of which is incorporated by reference:

U.S. Patent Application Publication US 2014/0283289 A1 of Damon Hawkins published Sep. 25, 2014 with the title "Anti-slip slip-on slip-over roof safety shorts," and is incorporated herein by reference. Publication US 2014/0283289 describes reduced coefficient of sliding friction between the wearer and the steep sloped surface. The anti-slip clothing can be an article of clothing such as a shirt, vest, jacket, poncho, coveralls, overalls, pair of shorts, pair of pants, waist-sashes or partial leg coverings, calf and forearm coverings, slip-over clothing such as slip-over shirts and fastenable slip-over shorts worn on the body or over other conventional articles of clothing and which includes a gripping surface applied to an exterior or optionally to the interior surface of the article of clothing so that when the inside non-slip surface contacts with the existing wearers conventional existing clothing it prevents slippage between the anti-slip clothing and the wearers conventional existing clothing.

PCT Application Publication No. WO 2012/138569 A1 of Michael Baldino published Oct. 11, 2012 with the title "Apparatus and method for fabricating and using non-slip garments," and is incorporated herein by reference. Publication WO 2012/138569 describes a multilayered garment material that has a central layer composed of conventional fabric, an inner layer of highly frictional material that is distributed over large segments of the inner surface of the garment, and an outer layer of highly frictional material that is distributed over large segments of the outer surface of the garment. The external layers of frictional material prevent slippage of the garment on the skin, and slippage of the garment when it is in contact with external surfaces. While any number of suitable materials can be used as the high friction material. In one preferred but non-limiting embodiment the high friction material may be silicone material or another high friction rubber such as Spand-E-Sol™, commercially available from Rutland Technologies headquartered in North Carolina.

U.S. Patent Application Publication US 2017/0013888 of Jasen L. Webb published Jan. 19, 2017 with the title "Functional and aesthetic frictional support," and is incorporated herein by reference. Publication US 2017/0013888 describes a garment configured to aid in frictional support for a user during an exercise to reduce slipping and sliding between the garment and an object. The garment includes gripping areas located on a front or back of the garment. Gripping areas of various different shapes and sizes may be located in a multiplicity of suitable areas of the garment. Gripping areas may be applied to an outer and/or inner surface of the fabric of the garment. Gripping areas may be made of a grip material that exerts a greater frictional force on the object in contact with the gripping areas. Gripping areas may include multiple gripping members of various different shapes and patterns. These various gripping patterns and shapes enable the gripping areas to provide an aesthetically pleasing and functional garment, at the same time, maintain the breathability of the fabric from which the garment is made.

PCT Application Publication WO 2008/094049 A1 of Burkhard Bönigk published Aug. 7, 2008 with the title "A textile material," and is incorporated herein by reference. Publication WO 2008/094049 describes a device to be fitted to an automobile wheel in order to increase friction between the wheel and the road surface during winter conditions that is made substantially from textile material and includes a belt to encircle the tread of the wheel and be held in place by outer and inner side portions, the inner side portion having an elastic member. The belt of the device is made from a band of textile material provided with stripes) of abrasive material set in a matrix of a binding agent adhering firmly to the band material.

European Application Publication No. EP 2006127 A2 of Tatsuo Konishi et al. published Dec. 24, 2008 with the title "Tire chain made of textile," and is incorporated herein by reference. Publication EP 2006127 describes a tire chain made of fiber excellent in weight saving and storage property. that is excellent in durability, braking performance, and hill-climbing performance. The fiber tire chain is removably installed to a tire and is made of a knit fabric in which at least a portion covering a contact patch of a tire. A relationship between a space area (S) of a mesh of knit fabric and a width (W) of a strand of the knit fabric satisfies $2 \leq S1/2/W \leq 15$. A thickness of a burl portion of the knit fabric (knit fabric portion) is three times or less as a thickness of a net leg portion of the knit fabric.

United States Patent Publication US 2010/0162590 of Burkhard Bonigk published on Jul. 1, 2010 with the title "Friction enhancing device," and is incorporated herein by reference. Patent Publication 2010/0162590 describes a sole for a pedestrian's shoe or a slipover device for such a shoe has a base consisting of a non-woven microfiber material made of thermoplastic polyester PVC knobs or polyamide.

The microfiber material is exposed in an arcuate section in the front foot portion, in the mid-foot portion and in a wheel-shaped section in the heel portion of the sole. An elastomer material is deposited as rounded knobs onto the microfiber material in a fore portion of the front foot portion and in a ring and sectors in the heel portion of the sole. A PVC material is deposited, also in the form of rounded knobs, in a transverse band in the front foot portion and in a larger part of the heel portion so as to surround the ring. The use of the microfiber material as a means of enhancing friction on an icy surface is also disclosed.

According to www.interweave.com/article/weaving/what-is-terry-cloth/, "Terry-cloth is a pile weave, which means that there are uncut loops woven into the fabric on one or both sides, which are raised above the groundcloth. Pile weaves can have cut or uncut loops, woven either weft-wise or warp-wise, but terry-cloth is always warp-wise, hence the need for supplemental warps! The first terry-cloth towels were handwoven from silk, made in France in 1841. The name 'terry' came from the French word 'tirer,' which means 'to pull out or through.' This clearly referred to the supplemental warps, which were 'pulled out' to create the distinctive loops that make terry-cloth so absorbent and soft. Throughout the mid-1800s, several British and United States manufacturers began mass-producing woolen and then cotton terry-cloth. Both industrially and in the home, terry-cloth is usually woven on a loom with two warp beams: one for the groundcloth warp threads, and one for the pile warp."

U.S. Pat. No. 7,044,173 to Silver issued on May 16, 2006 with the title "Microfiber towel with cotton base," and is incorporated herein by reference. U.S. Pat. No. 7,044,173 describes a terry fabric having increased static and dynamic absorbency includes a ground fabric having opposing first and second surfaces and woven from ground warp yarns and ground fill yarns, each of the ground warp yarns and ground fill yarns consisting of at least one cellulosic fiber; and terry warp yarns interwoven with the ground warp yarns and ground fill yarns to form terry loops extending from opposing surfaces of the ground fabric, the pile yarns consisting of microfiber.

United States Patent Application Publication 2004/0224121 by Sheppard published on Nov. 11, 2004 with the title "Towel fabric with cotton and microfiber faces," and is incorporated herein by reference. Patent Publication 2004/0224121 describes a fabric for decorative towels that combines exceptional hand and image-carrying capability with high strength and absorbency. The fabric includes two different pile faces, preferably opposite one another, with one of the faces being formed of synthetic filaments of 0.9 denier or less—i.e., microfibers—for providing strength and absorbency, with the other of the faces of the fabric being formed of cotton for providing desirable hand and decorative design capabilities, and with the synthetic microfiber face being more absorbent on a weight-for-weight basis than the cotton face.

U.S. Pat. No. 7,465,683 to McMurray issued on Dec. 16, 2008 with the title "Functional double-faced performance warp knit fabric, method of manufacturing, and products made there from," and is incorporated herein by reference. U.S. Pat. No. 7,465,683 describes an integrally formed stretch warp knit fabric structure formed using at least three guide bars, a fully or partly threaded first front guide bar, a second fully or partly threaded middle guide bar and third fully or partly threaded back guide bar that are knitted to form one single layer fabric having definitive two-sided qualities; and a method of making the fabric; and articles using said fabric.

There remains a need for a slide-inhibiting garment to quickly slow down sliding on ice or snow, especially hockey players and other ice skaters.

SUMMARY OF THE INVENTION

The present invention provides a method and apparatus for inhibiting sliding on ice, for example garments such as hockey jerseys and/or hockey pants made of a material, such as microfiber cloth, that inhibits sliding when a hockey player falls to the ice at speed.

In some embodiments, the hockey garment includes an outer layer of micro-fiber material. The garment is optionally a hockey jersey, pants, elbow covering, kneepad covering, shin covering, forearm covering, and/or gloves having a plurality of separated patches of micro-fiber material. Optionally, the garment includes stitching that sews the micro-fiber material to a plurality of inner cloth layers using a plurality of at least five curvilinear stitching paths equally spaced from one another through a first area of the garment and a plurality of at least five curvilinear paths equally spaced from one another through a second area of the garment spaced apart from the first area.

BRIEF DESCRIPTION OF THE DRAWINGS

FIG. 1A1 is a front view of a hockey-garment set 101 of garments for hockey, each having a micro-fiber cloth on at least a portion of its surface for the purpose of inhibiting sliding, according to some embodiments of the present invention.

FIG. 1B1 is a cross-section view of a hockey-jersey garment 110 for hockey (at section line 1A1 through the torso and sleeves of hockey-jersey garment 110 of FIG. 1A1), having micro-fiber cloth on substantially all of its inner and outer surfaces for the purpose of inhibiting sliding, according to some embodiments of the present invention.

FIG. 1A2 is a front view of a hockey-jersey garment 110.2 having a micro-fiber cloth on at least a portion of its surface for the purpose of inhibiting sliding, according to some embodiments of the present invention.

FIG. 1B2 is a cross-section view of a hockey-jersey garment 110.2 for hockey (at a plane of section line 1B2 through the torso and sleeves of the hockey-jersey garment 110.2 of FIG. 1A2), having micro-fiber cloth on most of the outermost portions of its inner and outer surfaces for the purpose of inhibiting sliding, according to some embodiments of the present invention.

FIG. 1A3 is a front view of a hockey-jersey garment 110.3 having a micro-fiber cloth on at least a portion of its surface for the purpose of inhibiting sliding, according to some embodiments of the present invention.

FIG. 1B3 is a cross-section view of a hockey-jersey garment 110.3 for hockey (at a plane of section line 1B3 through the torso and sleeves of the hockey-jersey garment 110.3 of FIG. 1A3), having micro-fiber cloth patches on many of the outermost portions of its inner and outer surfaces for the purpose of inhibiting sliding, according to some embodiments of the present invention.

FIG. 1A4 is a front view of a light-weight breathable moisture-wicking hockey-jersey garment 120 made of a microfiber cloth that is knitted or otherwise fabricated such that through-holes provide airflow to reduce overheating during exertion, and in some embodiments, having a micro-fiber yarns on perforated fabric for the purpose of inhibiting sliding, according to some embodiments of the present invention.

FIG. 1B4 is a cross-section view of a hockey-jersey garment 120 for hockey (at a plane similar to section line 1B4 through the torso and sleeves of the hockey-jersey garment 120 of FIG. 1A4), according to some embodiments of the present invention.

FIG. 1A5 is a front view of a hockey-jersey garment 110.5 having a micro-fiber cloth on at least a portion of its surface for the purpose of inhibiting sliding, according to some embodiments of the present invention.

FIG. 1B5 is a cross-section view of a hockey-jersey garment 110.5 for hockey (at a plane similar to section line 1B5 through the torso and sleeves of the hockey-jersey garment 110.5 of FIG. 1A5), having micro-fiber cloth on many of just outer surfaces for the purpose of inhibiting sliding, according to some embodiments of the present invention.

FIG. 1A6 is a front view of a hockey-jersey garment 110.6 having a micro-fiber cloth on at least a portion of its surface for the purpose of inhibiting sliding, according to some embodiments of the present invention.

FIG. 1B6 is a cross-section view of a hockey-jersey garment 110.6 for hockey (at a plane similar to section line 1B6 through the torso and sleeves of the hockey-jersey garment 110.6 of FIG. 1A6), having micro-fiber cloth on many of just outer surfaces for the purpose of inhibiting sliding, according to some embodiments of the present invention.

FIG. 1A7 is a front view of a hockey-jersey garment 110.7 having a micro-fiber cloth on at least a portion of its surface for the purpose of inhibiting sliding, according to some embodiments of the present invention.

FIG. 2A is a table of test results of sliding with a conventional polyester-cloth hockey jersey versus sliding with a micro-fiber-cloth hockey jersey of the present invention.

FIG. 2B is a top-view diagram of a conventional hockey rink.

DESCRIPTION OF PREFERRED EMBODIMENTS

Figure 2C:
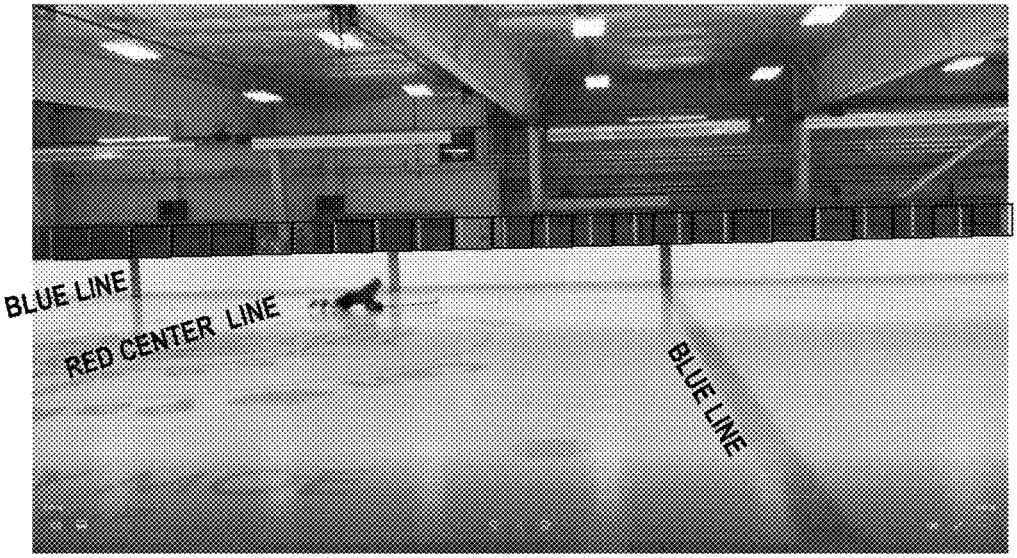
FIGS. 2C and 2D are photos of the start and end of sliding with a conventional polyester-cloth hockey jersey.

Although the following detailed description contains many specifics for the purpose of illustration, a person of ordinary skill in the art will appreciate that many variations and alterations to the following details are within the scope of the invention. Specific examples are used to illustrate particular embodiments; however, the invention described in the claims is not intended to be limited to only these examples, but rather includes the full scope of the attached claims. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. The embodiments shown in the Figures and described here may include features that are not included in all specific embodiments. A particular embodiment may include only a subset of all of the features described, or a particular embodiment may include all of the features described.

It is specifically contemplated that the present invention includes embodiments having combinations and subcombinations of the various embodiments and features that are individually described herein (i.e., rather than listing every combinatorial of the elements, this specification includes descriptions of representative embodiments and contemplates embodiments that include some of the features from one embodiment combined with some of the features of another embodiment, including embodiments that include some of the features from one embodiment combined with some of the features of embodiments described in the patents and application publications incorporated by reference in the present application). Further, some embodiments include fewer than all the components described as part of any one of the embodiments described herein.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Some embodiments of the present invention include a method and apparatus for inhibiting sliding on ice; for example, garments such as hockey jerseys and/or hockey pants made at least partially of a material, such as microfiber cloth, that inhibits sliding when the hockey player falls to the ice at speed wearing such garments. In some embodiments, a terry-cloth fabric such as described in U.S. Pat. No. 7,044,173 is used to make the slide-inhibiting garment of the present invention. In some embodiments, a terry-cloth fabric such as described in United States Patent Publication 2004/0224121 is used to make the slide-inhibiting garment of the present invention, with the micro-fiber pile yarns on the outer face of the garment and the cotton pile yarns on the inner face for a more comfortable feel against the skin of the hockey player. In some embodiments, a knit fabric using microfiber is used for the present invention (such as described in U.S. Pat. No. 7,465,683 that issued to McMurray on Dec. 16, 2008 with the title "Functional double-faced performance warp knit fabric, method of manufacturing, and products made there from," and which is incorporated herein by reference. In other embodiments, knit fabrics (such as, for example, tricot knit, micro-knit, micro-denier knits (e.g., using fibers of less than one denier (also called microfibers)), open knits, mesh knit, warp knit, weft knit, air knits, "porthole" mesh, pin-hole mesh and the like) made of microfibers are used. Weft knitting is a method of forming a fabric in which the loops are made in horizontal way from a single yarn and intermeshing of loops take place in a circular or flat form on across-wise basis. Warp knitting is a method of forming a fabric in which the loops are made in vertical way along the length of the fabric from each warp yarns and intermeshing of loops take place in a flat form of length-wise basis.

In some embodiments, the pile loops on the terry-cloth outer face of the garment are each cut open to expose more fiber ends to the ice, while the pile loops on the inner face of the garment are uncut in order to provide a more comfortable feel to the player's skin. In some embodiments, the inner face of the garment has no pile loops, and only the outer face has micro-fiber pile structures, and in some such embodiments, pile loops on the outer face of the garment are each cut open to expose more fiber ends to the ice.

FIG. 1A1 is a front view of a hockey-garment set 101 of garments for hockey, each having a micro-fiber cloth on at least a portion of its surface for the purpose of inhibiting sliding, according to some embodiments of the present invention. In some embodiments, hockey-garment set 101 includes a hockey jersey 110, hockey pants (also known as hockey breezers) 130 or alternative hockey pants 140, elbow covering 111 or elbow covering 131, forearm covering 112 or forearm covering 132, knee covering 113 or knee covering 133, shin covering 114 or shin covering 134. In some embodiments, the garments (e.g., those with reference numbers in the range 110-134) have all or substantially all of their outer surfaces covered by or made with micro-fiber material. In other embodiments, the garments (e.g., hockey pants 140) have patches 141 or stripes 142 of micro-fiber material sewn or glued in separated locations on the garment. In some embodiments, the patches are built in as part of the weaving process to make the microfiber cloth, such as sheared or looped terry cloth as described in U.S. Pat. No. 7,044,173 or double-faced warp knit fabric as described in U.S. Pat. No. 7,465,683. In some embodiments, hockey gloves 119 are provided with slide-inhibiting fabric on cuffs 129 and/or the front and/or back of the gloves 119. In some embodiments, the garments (e.g., 110, 131, 132, 133, 134) include stitching 139 that sews the outer layer of micro-fiber material 152 (see FIG. 1B1) to an inner cloth layer 153 using a plurality of stitching paths (e.g., in some embodiments, evenly spaced curvilinear or parallel straight line paths) across one or more areas or sections of the garment spaced from an outer edge of the garment (e.g., in some embodiments, parallel rows of stitching) to hold the microfiber covering to the breathable jersey layer 151 (in some embodiments, having a plurality of small holes or perforations to allow air to flow through for cooling the athlete), and/or the strengthening and anti-slip (e.g., in some embodiments, another microfiber layer) fabric 153 underneath.

In some embodiments, the microfiber covering 152 is attached (e.g., by sewing or adhesive or hook-and-loop (e.g., Velcro® brand) material) to pads (such as, for example, elbow pads 111 or 131, forearm pads 112 or 132, knee pads 113 or 133 and/or shin pads 114 or 134) that the player normally wears to protect, for example, elbows, forearms, shoulders, knees, shins and the like.

In some embodiments, microfiber fabric 152 is sewn or otherwise attached as an outside covering 151 to reduce sliding on ice, and, in some embodiments, microfiber fabric 153 is also sewn or otherwise attached on an inner surface of the garment fabric 151 to reduce sliding of the garment relative to undergarments, padding and/or the skin of the person wearing the garment.

In preliminary testing, a player wearing the slide-inhibiting hockey jersey garment of the present invention slid for less than half the distance to which that same player slid when wearing a conventional polyester hockey jersey.

FIG. 1B1 is a cross-section view of a hockey-jersey garment 110 for hockey (at section line 1B1 through the torso and sleeves of hockey-jersey garment 110 of FIG. 1A1), having micro-fiber cloth 152 and 153 on substantially all of its inner and outer surfaces of jersey fabric 151 for the purpose of inhibiting sliding, according to some embodiments of the present invention. In some embodiments, the jersey fabric 151 and the microfiber fabric are both light weight and perforated with small holes to improve airflow through the fabric layer(s).

FIG. 1A2 is a front view of a hockey-jersey garment 110.2 having a micro-fiber cloth on most or at least a portion of its surface for the purpose of inhibiting sliding, according to some embodiments of the present invention. In some embodiments, hockey-jersey garment 110.2 includes microfiber slide-inhibiting shoulder patches 161, sleeve patches 157, and/or torso patches 159 sewn or adhesively attached to the jersey fabric 151.

FIG. 1B2 is a cross-section view of a hockey-jersey garment 110.2 for hockey (at a plane of section line 1B2 through the torso and sleeves of the hockey-jersey garment 110.2 of FIG. 1A2), having micro-fiber cloth on most of the outermost portions of its inner and outer surfaces for the purpose of inhibiting sliding, according to some embodiments of the present invention. In some embodiments, hockey-jersey garment 110.2 includes microfiber slide-inhibiting sleeve patches 157 sewn through jersey fabric to inner, and/or torso patches 159 sewn or adhesively attached to the jersey fabric 151. In some embodiments, the microfiber piles are directly manufactured as part of jersey material 151. In some embodiments, the jersey material with the microfiber pile structures is made with air flow-through openings such as shown in FIG. 11 described below.

FIG. 1A3 is a front view of a hockey-jersey garment 110.3 having a micro-fiber cloth on at least a portion of its surface for the purpose of inhibiting sliding, according to some embodiments of the present invention. In some embodiments, hockey-jersey garment 110.3 includes outer-face shoulder areas 161, torso areas 162, sleeve areas 164, each having microfiber pile yarns on the outer face of jersey material 151.

Figure 11A:
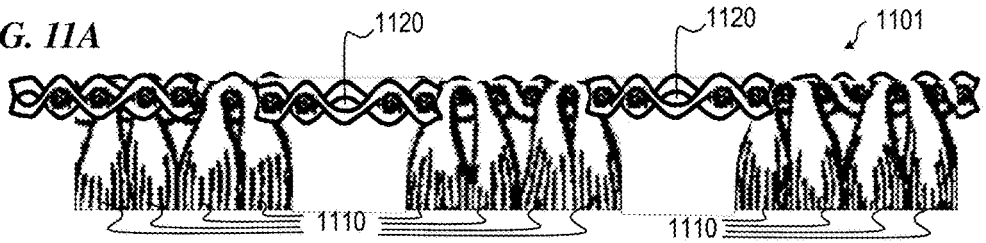
FIG. 11A is a magnified cross-section view of an air-flow terry-cloth fabric 1101 used in some embodiments of the present invention.
Figure 11B:
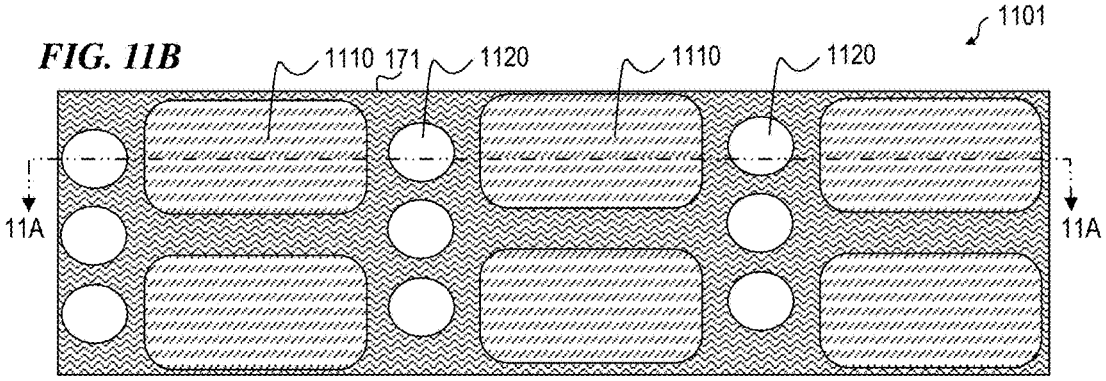
FIG. 11B is a magnified front view of an air-flow terry-cloth fabric 1101 used in some embodiments of the present invention.

FIG. 1B3 is a cross-section view of a hockey-jersey garment 110.3 for hockey (at a plane of section line 1B3 through the torso and sleeves of the hockey-jersey garment 110.3 of FIG. 1A3), having micro-fiber cloth patches on many of the outermost portions of its inner and outer surfaces for the purpose of inhibiting sliding, according to some embodiments of the present invention. In some embodiments, hockey-jersey garment 110.3 includes shoulder areas 161, torso areas 162, sleeve areas 164, each having microfiber pile yarns on the outer face of jersey material 151. In some embodiments, hockey-jersey garment 110.3 includes torso areas 163, sleeve areas 165, each having microfiber pile yarns on the inner face of jersey material 151. In some embodiments, the microfiber piles are directly manufactured as part of jersey material 151. In some embodiments, the jersey material with the microfiber pile structures is made with air flow-through openings such as shown in FIG. 11A and FIG. 11B described below. In other embodiments, microfiber fabric is sewn or adhered to jersey material 151.

FIG. 1A4 is a front view of a light-weight breathable moisture-wicking hockey-jersey garment 120 having a micro-fiber yarns on perforated fabric for the purpose of inhibiting sliding, according to some embodiments of the present invention. In some embodiments, rather than affixing conventional micro-fiber fabric to a jersey shirt substrate, the microfiber yarn pile structures 172 are formed into a breathable moisture-wicking fabric 171 that is a single-layer fabric and, in some embodiments, is optionally stretchable. In some embodiments, the fabric includes a sufficient amount of a stretchable material such as Spandex® yarn. In some embodiments, the microfiber strands include at least 70% polyester and no more than 30% polyamide. In some embodiments, the microfiber strands include about 80% polyester and about 20% polyamide. In some embodiments, the microfiber strands have a rough circumferential surface and a diameter of about 10 microns or smaller. In some embodiments, the microfiber pile loops on the outer surface of garment 120 are cut open such as shown in FIG. 11A. In some embodiments, the microfiber piles are directly manufactured as part of jersey material 171. In some embodiments, the jersey material with the microfiber pile structures is made with air flow-through openings 1120 such as shown in FIG. 11 described below.

FIG. 1B4 is a cross-section view of a hockey-jersey garment 120 for hockey (at a plane similar to section line 1B4 through the torso and sleeves of the hockey-jersey garment 120 of FIG. 1A4), according to some embodiments of the present invention. Please see FIG. 11A and FIG. 11B for more detailed views of some embodiments of fabric of hockey-jersey garment 120.

FIG. 1A5 is a front view of a hockey-jersey garment 110.5 having or made of a micro-fiber cloth on at least a portion of its surface for the purpose of inhibiting sliding, according to some embodiments of the present invention. In some embodiments, hockey-jersey garment 110.3 includes outer-face shoulder areas 161, torso areas 162, sleeve areas 164, each having microfiber pile yarns on the outer face of jersey material 151.

FIG. 1B5 is a cross-section view of a hockey-jersey garment 110.5 for hockey (at a plane similar to section line 1B5 through the torso and sleeves of the hockey-jersey garment 110.5 of FIG. 1A5), having micro-fiber cloth on many of just outer surfaces for the purpose of inhibiting sliding, according to some embodiments of the present invention.

FIG. 1A6 is a front view of a hockey-jersey garment 110.6 having a micro-fiber cloth on at least a portion of its surface for the purpose of inhibiting sliding, according to some embodiments of the present invention. In some embodiments, hockey-jersey garment 110.6 includes a plurality of outer-face rounded, circular or oval areas 161, torso areas 162 and/or sleeve areas 164, each having microfiber pile yarns on the outer face of jersey material 151.

FIG. 1B6 is a cross-section view of a hockey-jersey garment 110.6 for hockey (at a plane similar to section line 1B6 through the torso and sleeves of the hockey-jersey garment 110.6 of FIG. 1A6), having micro-fiber cloth on many of just outer surfaces for the purpose of inhibiting sliding, according to some embodiments of the present invention. In some embodiments, hockey-jersey garment 110.6 includes a plurality of outer-face rounded, circular or oval areas 161, torso areas 162 and/or sleeve areas 164, each having microfiber pile yarns on the outer face of jersey material 151. In some embodiments, hockey-jersey garment 110.6 includes a plurality of inner-face rounded, circular or oval torso areas 163 and/or sleeve areas 165, each having microfiber pile yarns on the inner face of jersey material 151.

FIG. 1A7 is a front view of a hockey-jersey garment 110.7 having a micro-fiber cloth on at least a portion of its surface for the purpose of inhibiting sliding, according to some embodiments of the present invention. In some embodiments, hockey-jersey garment 110.7 includes a plurality of outer-face rounded, circular or oval areas 161, torso areas 162 and/or sleeve areas 164, each having microfiber pile yarns on the outer face of jersey material 151.

FIG. 2A is a table of test results of sliding with a conventional polyester-cloth hockey jersey versus sliding with a micro-fiber-cloth hockey jersey of the present invention.

FIG. 2B is a top-view diagram of a conventional hockey rink. In some embodiments, the blue lines are about twenty-five (25) feet from the center red line. For the sliding tests set forth below, the skater accelerated to a high speed starting at one blue line and then leaped flat on her abdomen on the ice once she reached the red center line and slid across the ice until friction stopped the slide.

Figure 2D:
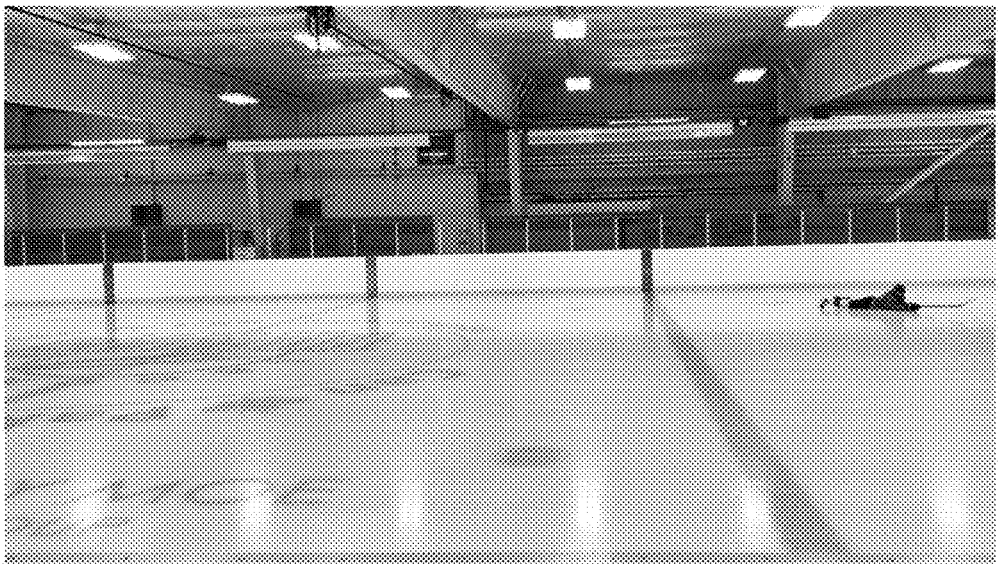

FIGS. 2C and 2D are photos of the start and end of sliding with a conventional polyester-cloth hockey jersey. This first sliding test, using conventional hockey garments, resulted in a slide distance of 40 feet 5 inches (about 12.3 meters).

Figure 2E:
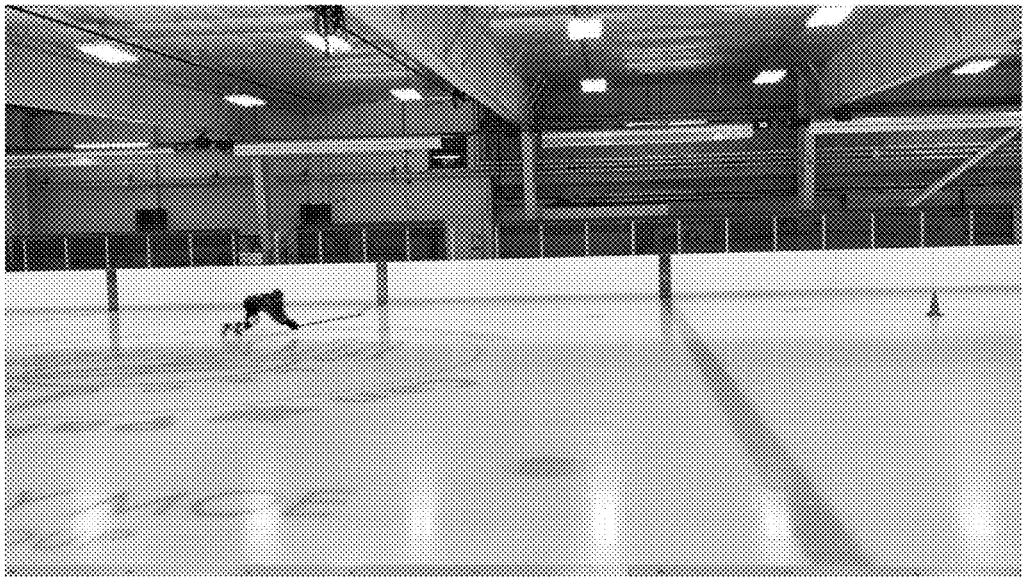
FIGS. 2E and 2F are photos of the start and end of sliding with the conventional polyester-cloth hockey jersey.
Figure 2F:
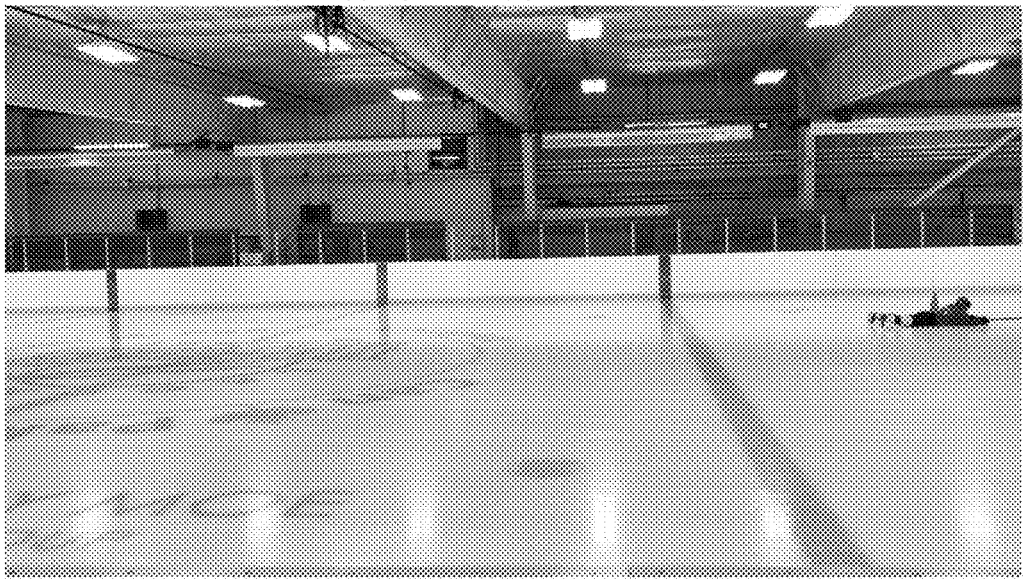

FIGS. 2E and 2F are photos of the start and end of sliding with the conventional polyester-cloth hockey jersey. This second sliding test, using conventional hockey garments, resulted in a slide distance of 40 feet 9 inches (about 12.4 meters).

Figure 3A:
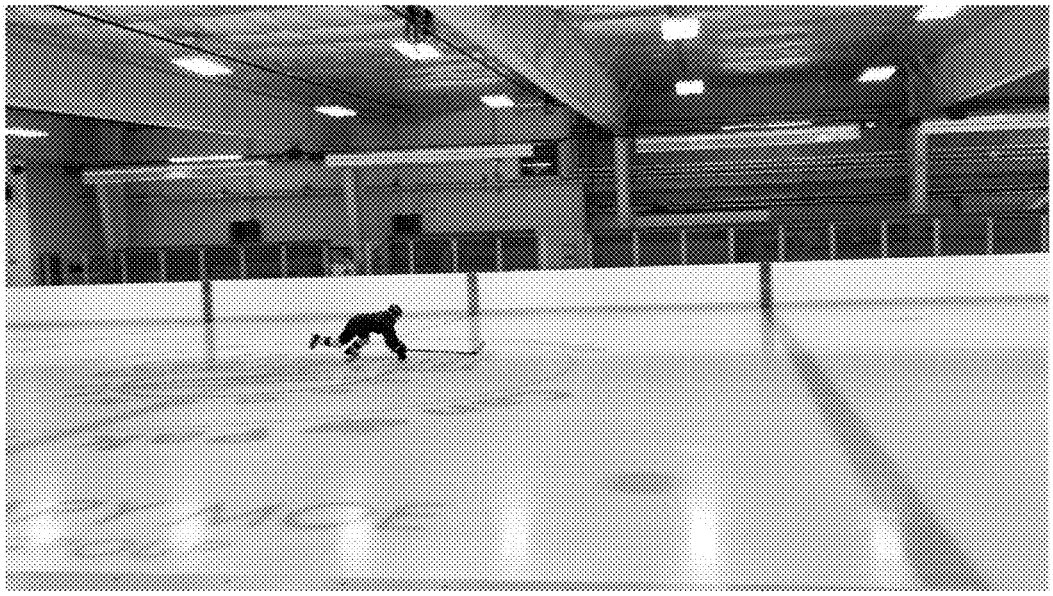
FIGS. 3A and 3B are photos of the start and end of sliding with a micro-fiber-cloth hockey jersey.
Figure 3B:
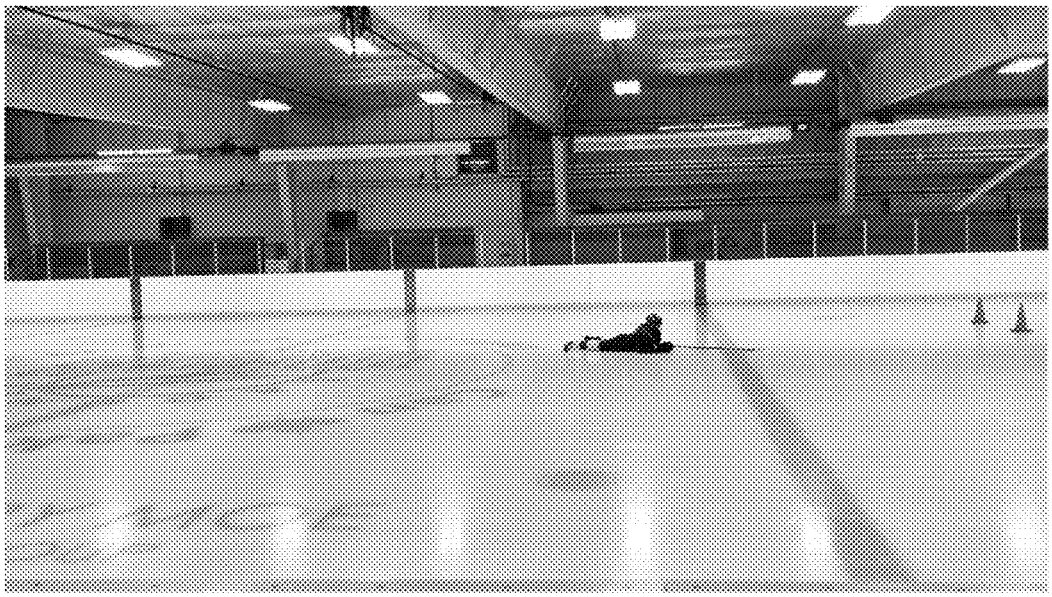

FIGS. 3A and 3B are photos of the start and end of sliding with a micro-fiber-cloth hockey jersey. This third sliding test, using slide-inhibiting hockey garments of the present invention, resulted in a slide distance of 22 feet 6 inches (about 6.86 meters).

Figure 4A:
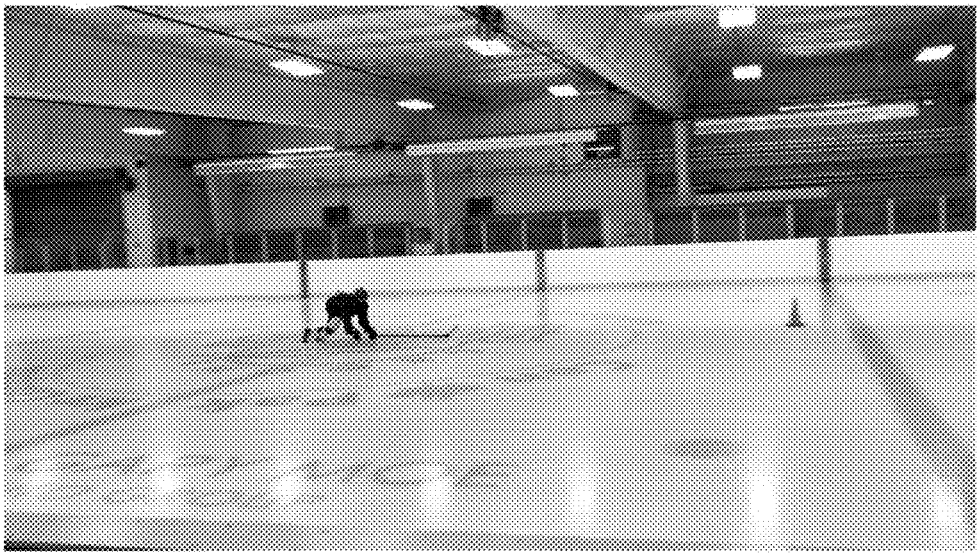
FIGS. 4A and 4B are photos of the start and end of sliding with the micro-fiber-cloth hockey jersey.
Figure 4B:
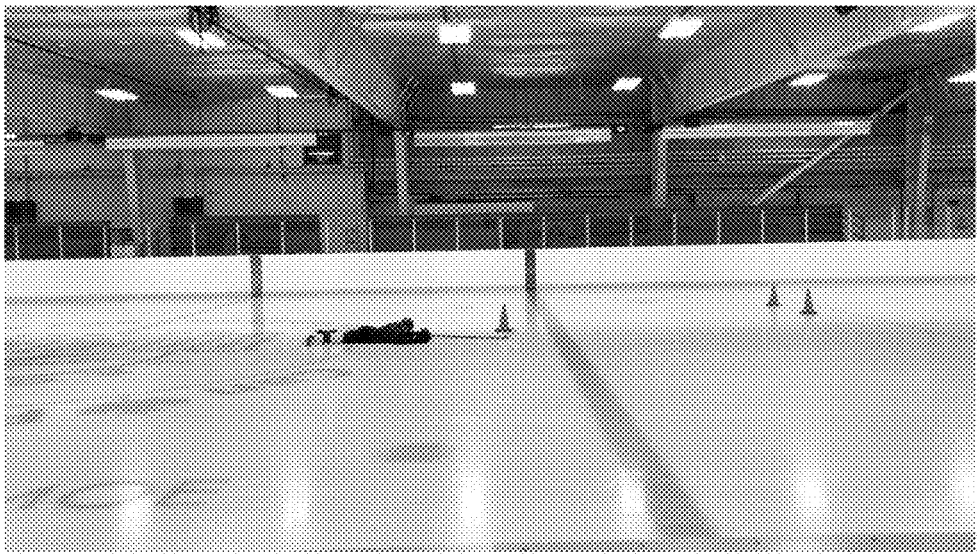

FIGS. 4A and 4B are photos of the start and end of sliding with a micro-fiber-cloth hockey jersey. This fourth sliding test, using slide-inhibiting hockey garments of the present invention, resulted in a slide distance of 17 feet 11 inches (about 5.46 meters).

Figure 5A:
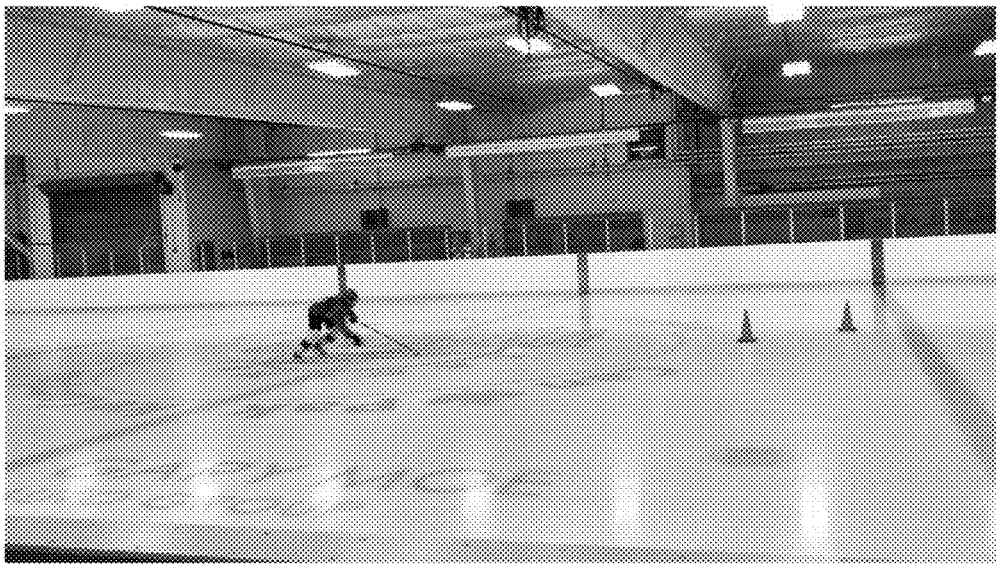
FIGS. 5A and 5B are photos of the start and end of sliding with the conventional polyester-cloth hockey jersey.
Figure 5B:
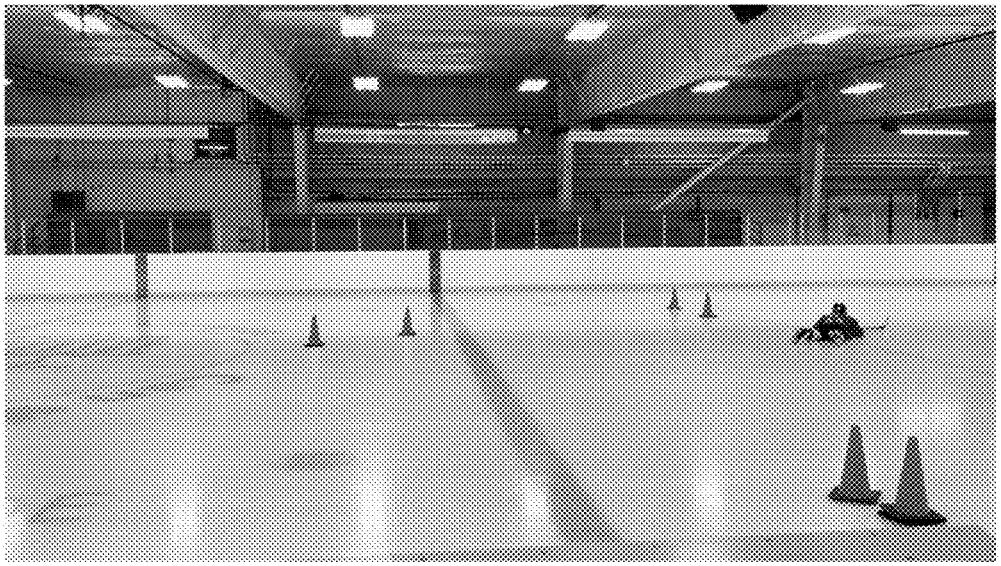

FIGS. 5A and 5B are photos of the start and end of sliding with a conventional polyester-cloth hockey jersey. This fifth sliding test, using conventional hockey garments, resulted in a slide distance of 44 feet 9 inches (about 13.6 meters).

Figure 6A:
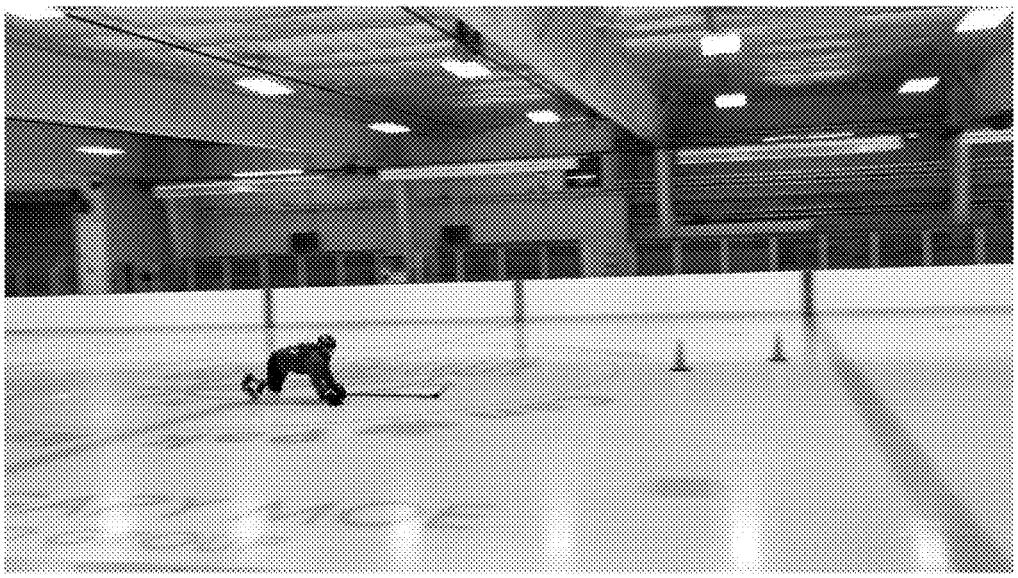
FIGS. 6A and 6B are photos of the start and end of sliding with the conventional polyester-cloth hockey jersey.
Figure 6B:
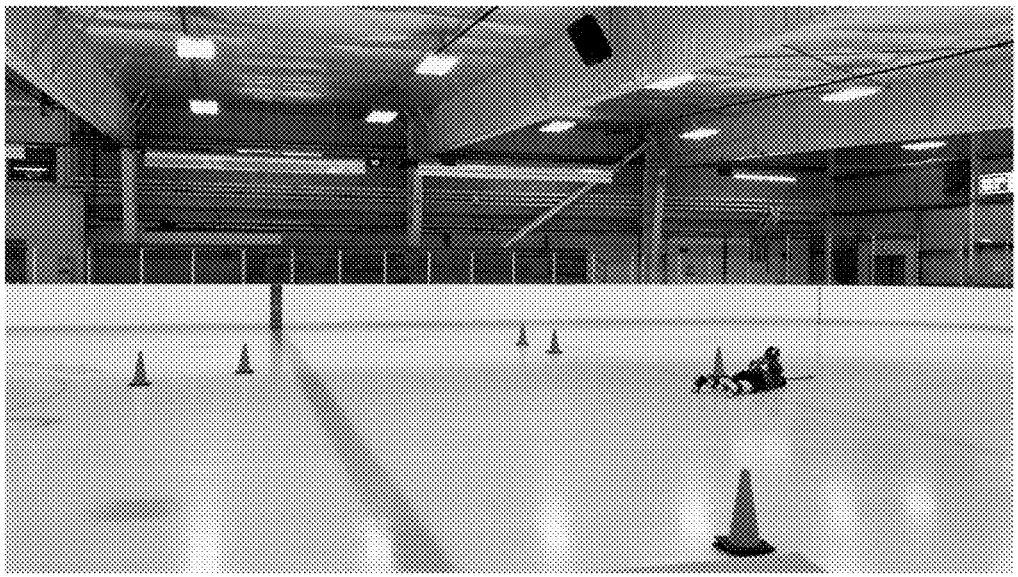

FIGS. 6A and 6B are photos of the start and end of sliding with a conventional polyester-cloth hockey jersey. This sixth sliding test, using conventional hockey garments, resulted in a slide distance of 46 feet 0 inches (about 14.0 meters).

Figure 7A:
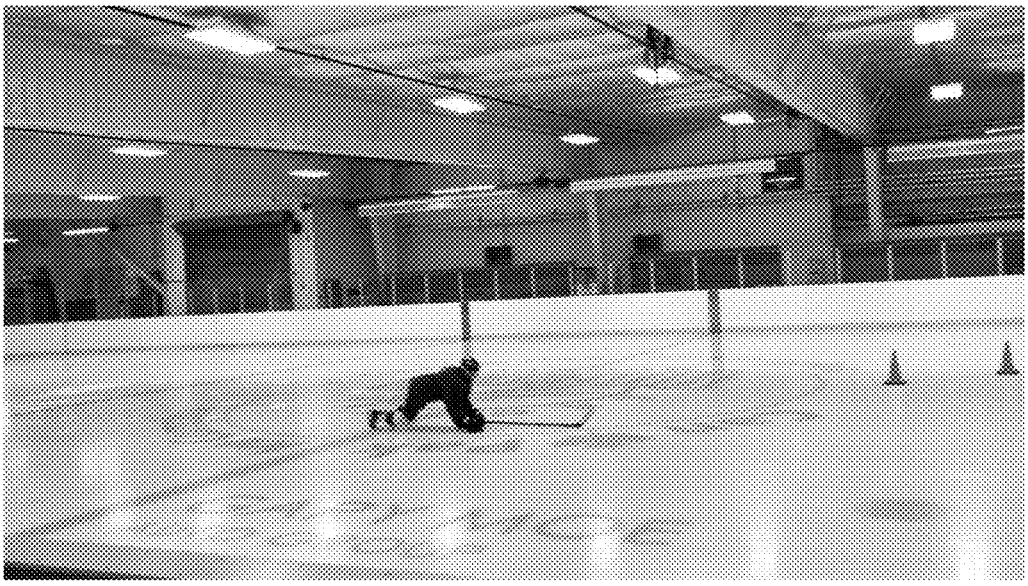
FIGS. 7A and 7B are photos of the start and end of sliding with the micro-fiber-cloth hockey jersey.
Figure 7B:
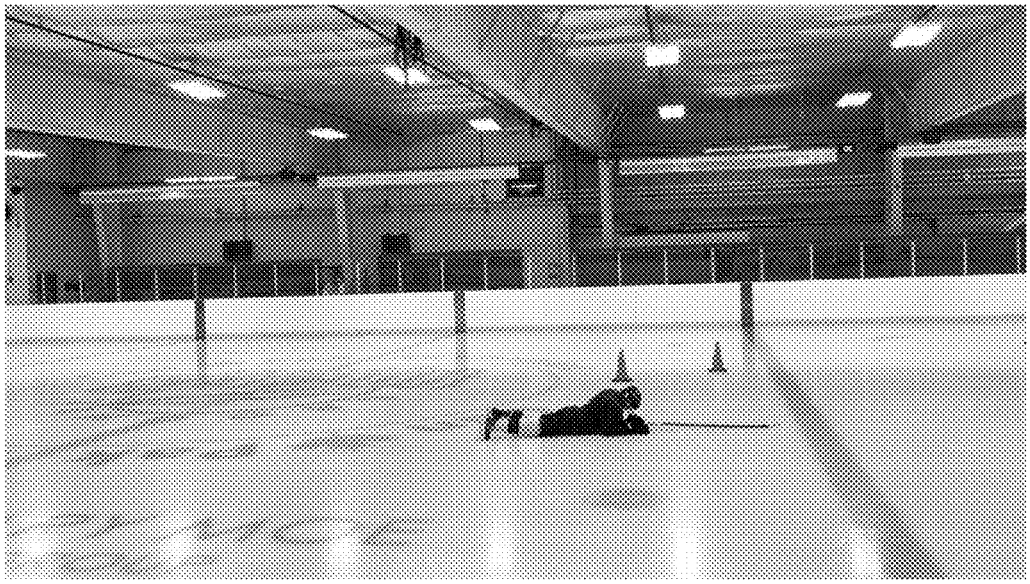

FIGS. 7A and 7B are photos of the start and end of sliding with a micro-fiber-cloth hockey jersey. This seventh sliding test, using slide-inhibiting hockey garments of the present invention, resulted in a slide distance of 20 feet 2 inches (about 6.15 meters).

Figure 8A:
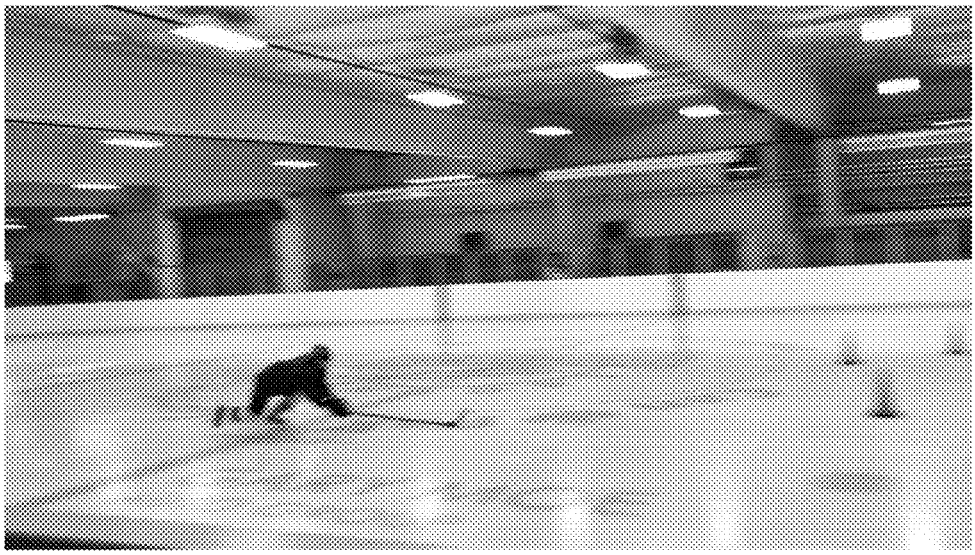
FIGS. 8A and 8B are photos of the start and end of sliding with the micro-fiber-cloth hockey jersey.
Figure 8B:
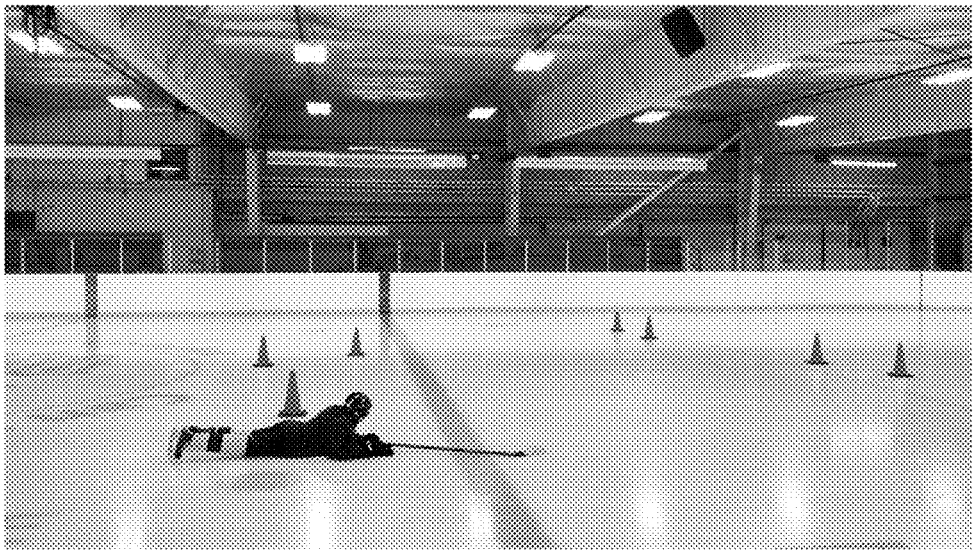

FIGS. 8A and 8B are photos of the start and end of sliding with a micro-fiber-cloth hockey jersey. This fourth sliding test, using slide-inhibiting hockey garments of the present invention, resulted in a slide distance of 23 feet 0 inches (about 7.01 meters).

For these tests, the average slide with conventional hockey garments was about 13.1 meters. The average slide with slide-inhibiting SafeSlide™ hockey garments of the present invention was about 6.37 meters, less than half the distance of slides with conventional hockey garments.

Figure 9:
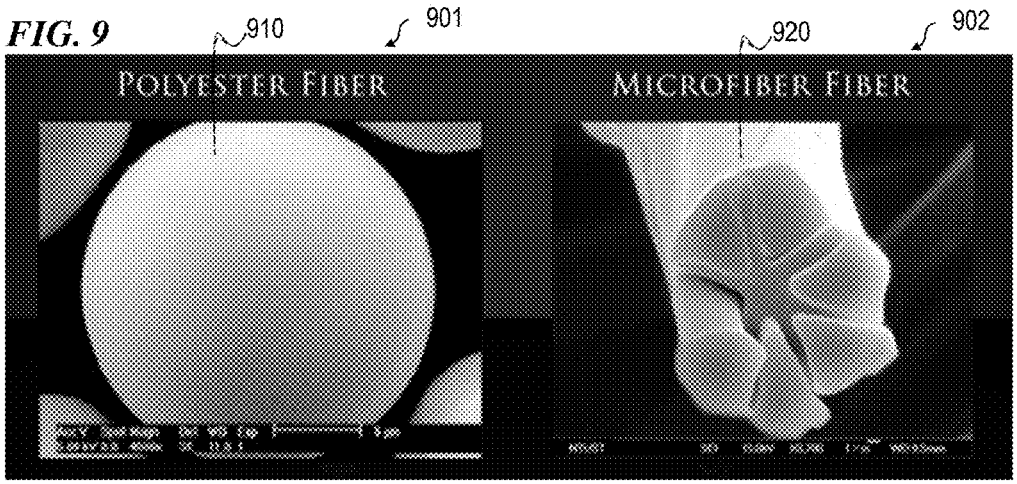
FIG. 9 is a microphotograph of a polyester fiber and of a polyester-polyamide composite fiber.

FIG. 9 includes two microphotographs of fibers. The microphotograph on 901 the left is a conventional polyester fiber 910 having a diameter of about 20 microns. The microphotograph 902 on the right is a microfiber 920 having a smaller diameter of less than 10 microns.

Figure 10A:
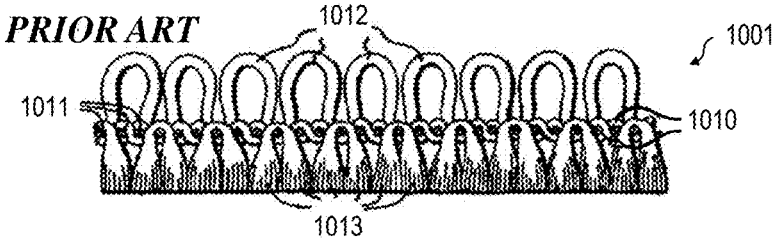
FIG. 10A PRIOR ART
FIG. 10A is a magnified cross-section view of a prior-art terry-cloth fabric 1001 that can be used in some embodiments of the present invention.

FIG. 10A is a magnified cross-section view of a prior-art terry-cloth fabric 1001 (such as described in U.S. Pat. No. 7,044,173 that issued to Silver on May 16, 2006 with the title "Microfiber towel with cotton base," and that is incorporated herein by reference) that can be used in some embodiments of the present invention. Terry fabric 1001 includes a woven ground or carrier fabric, which is woven from ground warp yarns 1010 and ground fill yarns 1011. Each set of ground warp yarns 1010 and ground fill yarns 1011 is independently composed of one or more or a blend of fibers, in which ground warp yarns 1010 and ground fill yarns 1011 are not necessarily the same composition. The terry warp yarns 1013 may be sheared to produce a terry velour, or left unsheared as a full loop pile 1012.

Figure 10B:
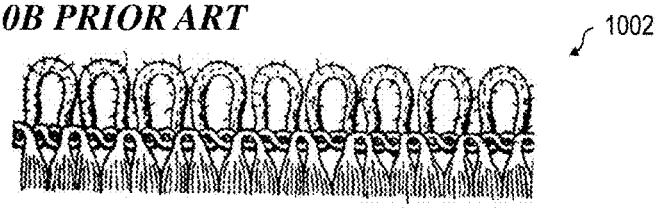
FIG. 10B PRIOR ART
FIG. 10B is a magnified cross-section view of a prior-art terry-cloth fabric 1002 that can be used in some embodiments of the present invention.

FIG. 10B is a magnified cross-section view of a prior-art terry-cloth fabric 1002 (such as United States Patent Application Publication 2004/0224121 by Sheppard published on Nov. 11, 2004 with the title "Towel fabric with cotton and microfiber faces," which is incorporated herein by reference) that can be used in some embodiments of the present invention.

FIG. 11A is a magnified cross-section schematic diagram (across section line 11A of FIG. 11B) of an air-flow terry-cloth fabric 1101 used in some embodiments of the present invention. In some embodiments, the terry warp yarns 1110 are sheared to produce a terry velour for slide-inhibiting garments (such as hockey-jersey garment 120 of FIG. 1A4 and FIG. 1B4). In other embodiments, these yarn pile loops are left unsheared as a full loop pile (such as loops 1012 of FIG. 10A). In some embodiments, holes 1120 are formed as part of the weaving, knitting or other manufacturing process.

FIG. 11B is a magnified front schematic diagram of an air-flow terry-cloth fabric 1101 used in some embodiments of the present invention. In some embodiments, terry-cloth pile loops are formed on just outer surfaces (e.g., in some embodiments, sheared microfiber piles made of a composite polyester-polyamide material) of an air-flow terry-cloth fabric 1101 as shown in FIG. 11A. In some embodiments, terry-cloth pile loops are formed on both the inner surfaces (e.g., in some embodiments, cotton loop piles) and outer surfaces (e.g., in some embodiments, sheared microfiber piles made of a composite polyester-polyamide material such as shown on the lower surface of FIG. 11A) of an air-flow terry-cloth fabric 1101 in a manner similar to that shown in FIG. 10A, but with air-flow-through openings as shown in FIG. 11B.

The University of Alberta provided the inventor with microfiber-fabric testing results. One will notice that the tested microfiber fabrics are very similar to each other with relatively small variations in fiber size and composition. The first sample (brown microfiber fabric) is the one used to make the jersey that was tested on ice as shown and described in FIGS. 2A-8B. From the labeling of the bolt in the store that it consists of microfiber pile on both faces of the fabric layer of 80% polyester and 20% polyamide, specifically nylon. While this fabric had very good anti-slide results, it is fairly heavy and not as breathable due to having a base knit of regular polyester and pile on both sides. The image in FIG. 9 of a conventional polyester fiber and a microfiber of this sample show the size difference between the fibers of a regular polyester jersey (which are 20 microns or larger in diameter) and a microfiber jersey (which are 10 microns or smaller in diameter).

In some embodiments, additional or alternative types of microfiber fabric construction are used such as "weft knit", "warp pile knit" and "tricot knit".

Making mass-market commercial garments with nano fibers is currently cost prohibitive, but they are likely to become economical in a few years. In some embodiments, fabrics that include nanofibers are used in the present invention for applications that justify the cost delta. In some embodiments, mass-market commercial hockey garments or other sports apparel of the present invention will use nanofiber anti-slide fabrics in the future.

Description and Advantages of Some Embodiments of SafeSlide™ Garments

Many youth and adults are injured every year due to sliding on ice or snow into a hard or immovable object while engaged in sports activities. As an example, in ice hockey players are checked or trip and fall at a speed that results in a slide into the boards, goalposts or another player. This can result in concussions and other head injuries, broken bones, or spinal-column injuries that can result in paralysis or death.

The present invention seeks to eliminate or minimize these and other injuries that otherwise occur. In some embodiments, the present invention provides ice-sports or snow-sports apparel, uniforms or gear made for the purpose of decreasing the severity of collisions with boards, goal posts, people, trees, fences, and the like. This is accomplished by manufacturing or treating clothing and sports gear with materials that inhibit the duration and speed of sliding after falling on ice or snow. In some embodiments, the present invention includes a safety garment that includes a gripping surface applied to an exterior or optionally to the interior surface of the article of clothing so that when the inside non-slip surface contacts with the existing wearer's conventional existing clothing, the inside non-slip surface prevents slippage between the anti-slip clothing and the wearer's underlying conventional or existing clothing.

Examples of non-slip materials that could be manufactured as part of, or applied/affixed to the inside of the outer garment, for this non-slip purpose include, but are not limited to:

- high-coefficient-of-friction material;
- microfiber fabric;
- Breathable coated microfiber fabric;
- Polyester;
- Polyamide;
- Modal;
- Silica gel;
- Velcro® hooks or loops;
- Fabric, such as used in the "Autosock"®, a textile cover for tires designed to help vehicles get traction on snow and ice;
- Rubber coating, such as Performix 10013 Super Grip Fabric Spray or Plasti Dip®
- Silicone or another high friction rubber such as Spand-E-Sol™
- Materials that promote the formation of an electrostatic force between the clothing and ice surfaces
- a gripping material of said grip area comprising at least a silicone, a plastic, a rubber, a blend of silicone and plastic, a blend of silicone and rubber, a rubberized material, an elastomeric material, or a polymeric material, wherein said gripping material is configured to provide said frictional force on an object or surface, in contact with said grip area.

In some embodiments, these materials are manufactured or applied to a part or the totality of the clothing or sports gear in various combinations or patterns including, but not limited to:

- The entire garment made of or covered with micro-fiber cloth;
- Stripes of micro-fiber cloth sewn or held by adhesive to an underlying garment;
- Bands of micro-fiber cloth sewn or held by adhesive to an underlying garment;
- Panels of micro-fiber cloth sewn or held by adhesive to an underlying garment;
- Dots of micro-fiber cloth sewn or held by adhesive to an underlying garment;
- Lines of micro-fiber cloth sewn or held by adhesive to an underlying garment;
- Chevrons of micro-fiber cloth sewn or held by adhesive to an underlying garment;
- Waves of micro-fiber cloth sewn or held by adhesive to an underlying garment;
- Circles of micro-fiber cloth sewn or held by adhesive to an underlying garment;
- Embroidered micro-fiber cloth sewn or held by adhesive to an underlying garment;
- Crosshatch of micro-fiber cloth sewn or held by adhesive to an underlying garment;
- Ribbed micro-fiber cloth sewn or held by adhesive to an underlying garment;
- Quilted micro-fiber cloth and an intermediate padding material sewn to an underlying garment;
- Knitted garment that includes micro-fiber cloth sewn or held by adhesive to the knitted underlying garment;
- Mesh garment that includes micro-fiber cloth sewn or held by adhesive to the mesh underlying garment;
- Adhesive tape having a micro-fiber cloth outer surface, such that the micro-fiber adhesive tape can be applied to a person's clothing, gloves, skates or shoes;
- Straps of micro-fiber cloth that have buckles, snaps, hook-and-loop fasteners, lacing or the like;
- Belts having a micro-fiber cloth outer surface; and
- Adhesive coatings that are sprayed, brushed, impregnated or otherwise applied to the material of an underlying garment and then coated with micro-fiber fibers.

Examples of clothing or sports gear that can be manufactured or treated to achieve the desired anti-slide effect include, but are not limited to:

- Ice hockey, bandy, rink bandy, ringette, broomball, speed skating, figure skating, ice stock sport, curling, recreational skating, bobsledding, luge, skeleton, multiple types of skiing, snowboarding, ski jumping, skijoring, sledding, ice racing, ice speedway, ice sailing, mountain climbing, ice walking, ice climbing, etc., apparel or gear including jerseys, shirts, gloves, pants, belts, outfits, uniforms, tights, skirts, dresses, shirts, jackets, shorts, socks, leggings, leotards, helmets, headgear, toques, skates, shoes, liners, slip-over clothing, overalls, adhesive tape, straps or any practice or training clothing or gear.

In some embodiments, the present invention provides an apparatus for inhibiting sliding on ice (e.g., for figure skating or hockey) or snow (for downhill ski races and the like). This apparatus includes a garment that includes an outer surface layer of a micro-fiber material. In some embodiments, the micro-fiber material is a fabric having a terry-cloth pile weave using microfibers made of at least 60% polyester and no more than 40% polyamide. In some embodiments, the micro-fiber material is a fabric having a terry-cloth pile weave using microfibers made of at least 70% polyester and no more than 30% polyamide. In some embodiments, the micro-fiber material is a fabric having a terry-cloth pile weave using microfibers made of at least 80% polyester and no more than 20% polyamide. In some embodiments, the micro-fiber material is a fabric having a terry-cloth pile weave using microfibers made of 80% polyester and 20% polyamide. In some embodiments, the polyamide is Nylon®. In some embodiments, the polyamide includes Nylon®.

In some embodiments, the present invention provides an apparatus for inhibiting sliding on ice (e.g., for figure skating or hockey) or snow (for downhill ski racing. snowboarding, and the like). In some embodiments, this apparatus includes a hockey garment that includes an outer surface layer of a terry weave or knit fabric having micro-fiber pile yarns that, in some embodiments, include a composite of a polyester and a polyamide. In some embodiments, the micro-fiber material is a fabric having a terry-cloth pile weave using microfibers made of at least 60% polyester and no more than 40% polyamide. In some embodiments, the micro-fiber material is a fabric having a terry-cloth pile weave using microfibers made of at least 70% polyester and no more than 30% polyamide. In some embodiments, the micro-fiber material is a fabric having a terry-cloth pile weave using microfibers made of at least 80% polyester and no more than 20% polyamide. In some embodiments, the micro-fiber material is a fabric having a terry-cloth pile weave using microfibers made of 80% polyester and 20% polyamide. In some embodiments, the polyamide is Nylon®. In some embodiments, the polyamide includes Nylon®.

In some embodiments, the present invention provides an apparatus for inhibiting sliding on ice (e.g., for figure skating or hockey) or snow (for downhill ski races and the like). This apparatus includes a garment that includes an outer surface layer of a mesh-knit fabric having micro-fiber yarns that, in some embodiments, include a composite of a polyester and a polyamide. In some embodiments, the micro-fiber yarns further include metal fibers. In some embodiments, the mesh-knit fabric includes an air-knit fabric, heavy mesh fabric and/or light-mesh fabric. In some embodiments, the mesh-knit fabric having micro-fiber yarns is a tricot-knit fabric. In some embodiments, the micro-fiber material is a mesh-knit fabric using microfibers made of at least 60% polyester and no more than 40% polyamide. In some embodiments, the micro-fiber material is a fabric having a mesh-knit fabric using microfibers made of at least 70% polyester and no more than 30% polyamide. In some embodiments, the micro-fiber material is a fabric having mesh-knit fabric using microfibers made of at least 80% polyester and no more than 20% polyamide. In some embodiments, the micro-fiber material is a fabric having a mesh-knit fabric using microfibers made of 80% polyester and 20% polyamide. In some embodiments, the polyamide is Nylon®. In some embodiments, the polyamide includes Nylon®.

In some embodiments, the outer surface layer is the only layer of the garment.

In some embodiments, the garment includes a hockey jersey.

In some embodiments, the garment includes hockey pants.

In some embodiments, the garment includes hockey gloves.

In some embodiments, the garment includes hockey elbow covering.

In some embodiments, the garment includes hockey knee covering.

In some embodiments, the garment includes hockey shin covering.

In some embodiments, the garment includes hockey forearm covering.

In some embodiments, the garment includes hockey pants having a plurality of separated patches of micro-fiber material.

In some embodiments, the garment is made of a lightweight breathable moisture-wicking fabric having microfiber yarns made of fibers with diameters of no more than ten (10) microns in diameter.

In some embodiments, the garment is made of a lightweight breathable moisture-wicking fabric having microfiber yarns made of fibers that have a composition of about 80% polyester and 20% polyamide with irregular non-cylindrical circumferences that have diameters of no more than ten (10) microns in diameter.

In some embodiments, wherein the garment is made of knit fabric having microfiber yarns made of fibers that have a composition of about 80% polyester and 20% polyamide with irregular non-cylindrical circumferences that have diameters of no more than ten (10) microns in diameter. In some embodiments, the knit fabric includes a tricot knit having raised parallel rows, with a spacing of about six (6) rows per centimeter.

In some embodiments, the garment has only the outer surface layer of fabric with no inner fabric layers facing against an inside face of the outer surface layer.

In some embodiments, the garment includes stitching that sews the micro-fiber material to at least one inner cloth layer using a plurality of stitching paths across a section of the garment spaced from an outer edge of the garment.

In some embodiments, the garment includes stitching that sews the micro-fiber material to at least one inner cloth layer using a plurality of at least three parallel stitching paths equally spaced from one another.

In some embodiments, the garment includes stitching that sews the micro-fiber material to a plurality of inner cloth layers using a plurality of at least five curvilinear stitching paths equally spaced from one another through a first area of the garment and a plurality of at least five curvilinear paths equally spaced from one another through a second area of the garment spaced apart from the first area.

In some embodiments, the garment includes adhesive that adheres the micro-fiber material to a plurality of inner cloth layers across a first area of the garment and across a second area of the garment spaced apart from the first area.

In some embodiments, the garment includes stitching that sews the micro-fiber material to a plurality of inner cloth layers using a plurality of at least five curvilinear stitching paths equally spaced from one another through a first area of the garment and a plurality of at least five curvilinear paths equally spaced from one another through a second area of the garment spaced apart from the first area.

In some embodiments, the garment includes a hockey jersey that has the outer surface layer of fabric having a micro-fiber pile on the front and back of a torso portion, and the outer portions of the hockey-jersey's sleeves, but not on the torso's under-arm portions nor on sleeve portions that contact the torso's under-arm portions.

In some embodiments, the garment includes a hockey jersey that has the outer surface layer of fabric having a micro-fiber-material pile covering all outer surfaces of the hockey jersey.

In some embodiments, the outer surface layer of fabric of the garment is the only layer of fabric.

In some embodiments, the present invention provides a slide-inhibiting hockey-garment kit that includes: a hockey jersey that includes an outer surface layer of a micro-fiber material; and hockey pants that include an outer surface layer of a micro-fiber material.

In some embodiments of the slide-inhibiting hockey-garment kit, the hockey jersey has the outer surface layer of micro-fiber material on the front and back of a torso portion, and the outer portions of the hockey-jersey's sleeves, but not on the torso's under-arm portions nor on sleeve portions that contact the torso's under-arm portions.

In some embodiments, the present invention provides an apparatus for inhibiting sliding on ice. This the apparatus includes a fabric garment; micro-fiber means for inhibiting sliding on ice; and means for affixing the micro-fiber means for inhibiting sliding across an outer surface area of the garment. Some embodiments further include a plurality of three or more equally spaced apart lines of stitching that affix the micro-fiber means for inhibiting sliding to a plurality of inner layers of the garment.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first, " "second," and "third," etc., are used merely as labels, and are not intended to impose numerical requirements on their objects.

What is claimed is:

1. An apparatus for inhibiting an ice-skater from sliding on an ice surface, the apparatus comprising:

an ice-hockey garment that includes a plurality of slide-inhibiting outer-surface fabric patches in separated locations on the garment, the patches having micro-fiber yarns that include polymer composite fibers of a polyester and a polyamide, wherein garment is perforated with small holes to improve airflow through the fabric layer, and wherein the micro-fiber yarns of the outer surface fabric patches are made of microfiber strands that have a composition of at least 70% polyester and no more than 30% polyamide with rough circumferential surfaces that have diameters of no more than ten (10) microns in diameter.

2. An apparatus for inhibiting an ice-skater from sliding on an ice surface, the apparatus comprising:

an ice-hockey garment that includes a slide-inhibiting outer-surface fabric layer having micro-fiber yarns that include polymer composite fibers of a polyester and a polyamide, wherein the garment has only the outer surface fabric layer with no inner fabric layers facing against an inside face of the outer surface fabric layer.

3. The apparatus of claim 2, wherein the garment includes hockey pants.

4. The apparatus of claim 2, wherein the garment includes at least one selected from a set consisting of a hockey glove, a hockey elbow covering and a hockey forearm covering.

5. The apparatus of claim 2, wherein the garment includes at least one selected from a set consisting of a hockey knee covering and a hockey shin covering.

6. An apparatus for inhibiting an ice-skater from sliding on an ice surface, the apparatus comprising:

an ice-hockey garment that includes a slide-inhibiting outer-surface fabric layer having micro-fiber yarns that include polymer composite fibers of a polyester and a polyamide, wherein the outer-surface fabric layer is made of a breathable moisture-wicking fabric, and wherein the micro-fiber yarns of the outer surface fabric include micro-fiber pile yarns made of fibers with diameters of no more than ten (10) microns in diameter.

7. An apparatus for inhibiting an ice-skater from sliding on an ice surface, the apparatus comprising:

an ice-hockey garment that includes a slide-inhibiting outer-surface fabric layer having micro-fiber yarns that include polymer composite fibers of a polyester and a polyamide, wherein the outer surface fabric layer is made of a breathable moisture-wicking fabric, and wherein the micro-fiber yarns of the outer surface fabric layer are made of fibers that have a composition of about 80% polyester and 20% polyamide with irregular non-cylindrical circumferences that have diameters of no more than ten (10) microns in diameter.

8. An apparatus for inhibiting an ice-skater from sliding on an ice surface, the apparatus comprising:

an ice-sport garment that includes a slide-inhibiting outer-surface fabric layer having micro-fiber yarns that include polymer composite fibers of a polyester and a polyamide, wherein the outer surface fabric layer is made of knit fabric, and wherein the micro-fiber yarns of the outer surface fabric layer are made of fibers that have a composition of about 80% polyester and 20% polyamide with irregular non-cylindrical circumferences that have diameters of no more than ten (10) microns in diameter.

9. The apparatus of claim 2, wherein the garment includes a hockey jersey.

10. An apparatus for inhibiting an ice-skater from sliding on an ice surface, the apparatus comprising:

an ice-hockey garment that includes a slide-inhibiting outer-surface fabric layer having micro-fiber yarns that include polymer composite fibers of a polyester and a polyamide, wherein the garment includes stitching that sews the outer surface fabric layer to at least one inner cloth layer using a plurality of at least three parallel stitching paths equally spaced from one another.

11. An apparatus for inhibiting an ice-skater from sliding on an ice surface, the apparatus comprising:

an ice-hockey garment that includes a slide-inhibiting outer-surface fabric layer having micro-fiber yarns that include polymer composite fibers of a polyester and a polyamide, wherein the garment includes stitching that sews the outer surface fabric layer to a plurality of inner cloth layers using a plurality of at least five curvilinear stitching paths equally spaced from one another through a first area of the garment and a plurality of at least five curvilinear paths equally spaced from one another through a second area of the garment spaced apart from the first area.

12. An apparatus for inhibiting an ice-skater from sliding on an ice surface, the apparatus comprising:

an ice-hockey garment that includes a slide-inhibiting outer-surface fabric layer having micro-fiber yarns that include polymer composite fibers of a polyester and a polyamide, wherein the garment includes adhesive that adheres the outer surface fabric layer to a plurality of inner cloth layers across a first area of the garment and across a second area of the garment spaced apart from the first area.

13. An apparatus for inhibiting sliding on ice, the apparatus comprising:

a hockey garment that includes an outer surface fabric layer having micro-fiber yarns that include polymer composite fibers of a polyester and a polyamide, wherein the garment includes a hockey jersey that includes a torso portion, under-arm portions, and sleeves, and wherein the outer surface fabric layer is on a front and back of the torso portion, and on outer portions of the sleeves, but not on the under-arm portions nor on portions of the sleeves that contact the under-arm portions.

14. The apparatus of claim 8, wherein the garment includes a hockey jersey that has the outer surface fabric layer covering all outer surfaces of the hockey jersey.

15. A slide-inhibiting hockey-garment kit comprising:

a hockey jersey that includes a first outer surface layer of micro-fiber material; and hockey pants that include a second outer surface layer of micro-fiber material, wherein the hockey jersey includes a torso portion, under-arm portions, and sleeves, and wherein the first outer surface layer of micro-fiber material is on a front and back of the torso portion, and on outer portions of the sleeves, but not on the under-arm portions nor on portions of the sleeves that contact the under-arm portions.

16. An apparatus for inhibiting an ice-skater from sliding on an ice surface, the apparatus comprising:

a fabric garment;

micro-fiber means for inhibiting sliding on ice; and means for affixing the micro-fiber means for inhibiting sliding to the garment to form an outer surface area of the garment, the means for affixing further comprising:

a plurality of three or more equally spaced apart lines of stitching that affix the micro-fiber means for inhibiting sliding to a plurality of inner layers of the garment.

17. An apparatus for inhibiting an ice-skater from sliding on an ice surface, the apparatus comprising:

a fabric garment;

micro-fiber means for inhibiting sliding on ice; and means for affixing the micro-fiber means for inhibiting sliding to the garment to form an outer surface area of the garment, wherein the fabric garment includes a hockey jersey that includes a torso portion, under-arm portions, and sleeves, and wherein the micro-fiber means is on a front and back of the torso portion, and on outer portions of the sleeves, but not on the under-arm portions nor on portions of the sleeves that contact the under-arm portions.

18. The apparatus of claim 13, wherein the outer surface fabric layer includes a terry-cloth pile weave using micro-fibers made of 80% polyester and 20% polyamide.

19. The apparatus of claim 2, wherein the outer surface fabric layer includes microfibers made of at least 70% polyester and no more than 30% polyamide.

20. The apparatus of claim 2, wherein the outer surface fabric layer includes microfibers made of at least 60% polyester and no more than 40% polyamide.

* * * * *